US008988969B2

(12) United States Patent
Wallbom et al.

(10) Patent No.: US 8,988,969 B2
(45) Date of Patent: Mar. 24, 2015

(54) DETECTION OF CROSS BORES INVOLVING BURIED UTILITIES

(75) Inventors: Mark Wallbom, Ocoee, FL (US); Gary Young, El Paso, TX (US)

(73) Assignee: Underground Imaging Technologies, Inc., Latham, NY (US)

( * ) Notice: Subject to any disclaimer, the term of this patent is extended or adjusted under 35 U.S.C. 154(b) by 1005 days.

(21) Appl. No.: 13/089,861

(22) Filed: Apr. 19, 2011

(65) Prior Publication Data

US 2011/0261649 A1 Oct. 27, 2011

Related U.S. Application Data

(60) Provisional application No. 61/327,507, filed on Apr. 23, 2010.

(51) Int. Cl.
*E21B 47/14* (2006.01)
*E21B 47/022* (2012.01)
*E21B 7/04* (2006.01)

(52) U.S. Cl.
CPC ..... *E21B 47/02208* (2013.01); *E21B 7/046* (2013.01)
USPC ..... 367/81; 367/82; 367/189; 73/1.82

(58) Field of Classification Search
None
See application file for complete search history.

(56) References Cited

U.S. PATENT DOCUMENTS

| | | | | |
|---|---|---|---|---|
| 4,386,409 | A | 5/1983 | Petroff | |
| 5,226,328 | A | 7/1993 | Petroff et al. | |
| 5,457,995 | A | 10/1995 | Staton et al. | |
| 6,003,376 | A | 12/1999 | Burns et al. | |
| 6,241,028 | B1 | 6/2001 | Bijleveld | |
| 6,386,037 | B1 * | 5/2002 | Kepler et al. | 73/579 |
| 7,096,279 | B2 | 8/2006 | Hartmann | |
| 7,102,508 | B2 | 9/2006 | Edelstein | |
| 8,547,428 | B1 * | 10/2013 | Olsson et al. | 348/84 |
| 2002/0162406 | A1 * | 11/2002 | Wentworth et al. | 73/865.8 |
| 2004/0160600 | A1 * | 8/2004 | Drost et al. | 356/241.1 |
| 2006/0290779 | A1 * | 12/2006 | Reverte et al. | 348/84 |
| 2008/0204008 | A1 * | 8/2008 | Paulson | 324/220 |
| 2009/0326865 | A1 * | 12/2009 | Ziegel et al. | 702/179 |
| 2010/0208055 | A1 * | 8/2010 | Olsson et al. | 348/84 |
| 2011/0061463 | A1 * | 3/2011 | Ersoy et al. | 73/584 |

OTHER PUBLICATIONS

Minnesota Department of Public Safety, "Alert Notice to Underground Gas Pipeline Operators", May 10, 2010, 3 pages.

* cited by examiner

*Primary Examiner* — Brian Zimmerman
*Assistant Examiner* — Kevin Lau
(74) *Attorney, Agent, or Firm* — Hollingsworth Davis, LLC

(57) ABSTRACT

Evaluating utilities involves generating an acoustic or seismic source signal, communicating the source signal to a first underground utility, moving a receiver through a second underground utility situated in proximity to the first utility, and monitoring for a cross bore involving the first and second utilities in response to receiving the source signal emanating from the first utility as the receiver progresses through the second utility. Utility evaluation may further involve detecting a cross bore involving the first and second utilities using monitoring data acquired by the receiver.

26 Claims, 19 Drawing Sheets

| City Block Info<br>Manhole Info<br>(MH-1 and MH-2 locations) | | |
|---|---|---|
| SLL | Signal Detected? | Down Stream Distance |
| 110a | No | 100 ft |
| 110b | No | 300 ft |
| 110c | Yes | 600 ft |
| ... | ... | ... |
| 110n | No | n-ft |

DETECTION OF CROSS BORES INVOLVING BURIED UTILITIES

RELATED PATENT DOCUMENTS

This application claims the benefit of Provisional Patent Application Ser. No. 61/327,507 filed on Apr. 23, 2010, to which priority is claimed under 35 U.S.C. §119(e), and which is incorporated herein by reference.

SUMMARY

Embodiments of the disclosure are directed to apparatuses and methods for monitoring for a cross bore involving two or more utilities. Embodiments of the disclosure are directed to apparatuses and methods for recording utility monitoring data and detecting a cross bore involving two or more utilities using recorded utility monitoring data. Embodiments of the disclosure are directed to apparatuses and methods for storing data concerning a cross bore involving two or more utilities and updating the stored cross bore data with confirmation information indicating whether or not a detected cross bore is an actual cross bore. Embodiments of the disclosure are directed to apparatuses and methods for collecting and managing cross bore data for locations and regions, such as by use of a utility mapping database or a geographic information system.

According to some embodiments, evaluating utilities involves generating an acoustic or seismic source signal, communicating the source signal to a first underground utility, moving a receiver through a second underground utility situated in proximity to the first utility, and monitoring for a cross bore involving the first and second utilities in response to receiving the source signal emanating from the first utility as the receiver progresses through the second utility. Methods may further involve detecting a cross bore involving the first and second utilities using monitoring data acquired by the receiver.

In accordance with other embodiments, evaluating utilities involves generating an acoustic or seismic source signal for each of a plurality of first underground utilities, communicating the source signals to the first utilities, moving a receiver through a second underground utility having one or more laterals situated in proximity to the respective first utilities, and monitoring for a cross bore involving any of the first utilities and the one or more laterals in response to receiving source signals emanating from any of the first utilities as the receiver progresses through the second utility. Methods may further involve detecting a cross bore involving any of the first utilities and the one or more laterals using monitoring data acquired by the receiver.

According to various embodiments, systems for evaluating utilities include a signal source apparatus comprising a signal source unit configured to generate an acoustic or seismic source signal, and a mounting arrangement configured to secure the signal source unit to a first underground utility and to facilitate communication of the source signal from the signal source unit to the first underground utility. A receiver apparatus includes a receiver unit comprising a receiver coupled to a memory. The receiver is configured for sensing the source signal and to output source signal data, and the memory is configured to store monitoring data comprising the source signal data. A transport apparatus includes a coupler configured to couple the receiver unit to the transport apparatus. The transport apparatus facilitates movement of the receiver unit through a second underground utility situated in proximity to the first utility. The monitoring data stored in the memory comprises source signal data indicative of a cross bore in response to the receiver sensing the source signal emanating from the first utility as the receiver progresses through the second utility. A processor may be configured to detect a cross bore involving the first and second utilities using monitoring data stored in the memory of the receiver unit.

In other embodiments, systems for evaluating utilities include a plurality of signal source apparatuses, each comprising a signal source unit configured to generate an acoustic or seismic source signal and a mounting arrangement configured to secure the signal source unit to a first underground utility and to facilitate communication of the source signal from the signal source unit to the first underground utility. A receiver apparatus includes a receiver unit comprising a receiver coupled to a memory. The receiver is configured for sensing the source signals and to output source signal data, and the memory is configured to store monitoring data comprising the source signal data. A transport apparatus includes a coupler configured to couple the receiver unit to the transport apparatus. The transport apparatus facilitates movement of the receiver unit through a second underground utility having one or more laterals situated in proximity to the respective first utilities. The monitoring data stored in the memory comprises source signal data indicative of a cross bore involving any of the first utilities and the one or more laterals in response to the receiver sensing source signals emanating from any of the first utilities as the receiver progresses through the second utility. A processor may be configured to detect a cross bore involving any of the first utilities and the one or more laterals using monitoring data stored in the memory of the receiver unit.

According to some embodiments, methods for evaluating utilities involve generating an acoustic or seismic source signal, communicating the source signal to a gas supply pipeline, moving a receiver through a sanitary or storm sewer situated in proximity to the gas supply pipeline, and monitoring for a cross bore involving the gas supply pipeline and the sewer in response to receiving the source signal emanating from the gas supply pipeline as the receiver progresses through the sewer. Methods may also involve detecting a cross bore involving the gas supply pipeline and the sewer using monitoring data acquired by the receiver.

In accordance with other embodiments, systems for evaluating utilities include a signal source apparatus comprising a signal source unit configured to generate an acoustic or seismic source signal and a mounting arrangement configured to secure the signal source unit to a gas supply pipeline and to facilitate communication of the source signal from the signal source unit to the gas supply pipeline. A receiver apparatus includes a receiver unit comprising a receiver coupled to a memory. The receiver is configured for sensing the source signal and to output source signal data, and the memory is configured to store monitoring data comprising the source signal data. A transport apparatus includes a coupler configured to couple the receiver unit to the transport apparatus. The transport apparatus facilitates movement of the receiver unit through a sanitary or storm sewer situated in proximity to the gas supply pipeline. A processor is configured to detect a cross bore involving the gas supply pipeline and the sanitary or storm sewer using monitoring data stored in the memory of the receiver unit.

These and other features can be understood in view of the following detailed discussion and the accompanying drawings.

BRIEF DESCRIPTION OF THE DRAWINGS

FIG. 20 shows a mounting arrangement for securely fastening a signal source to a gas supply pipeline in accordance with various embodiments.

DETAILED DESCRIPTION

Figure 1:
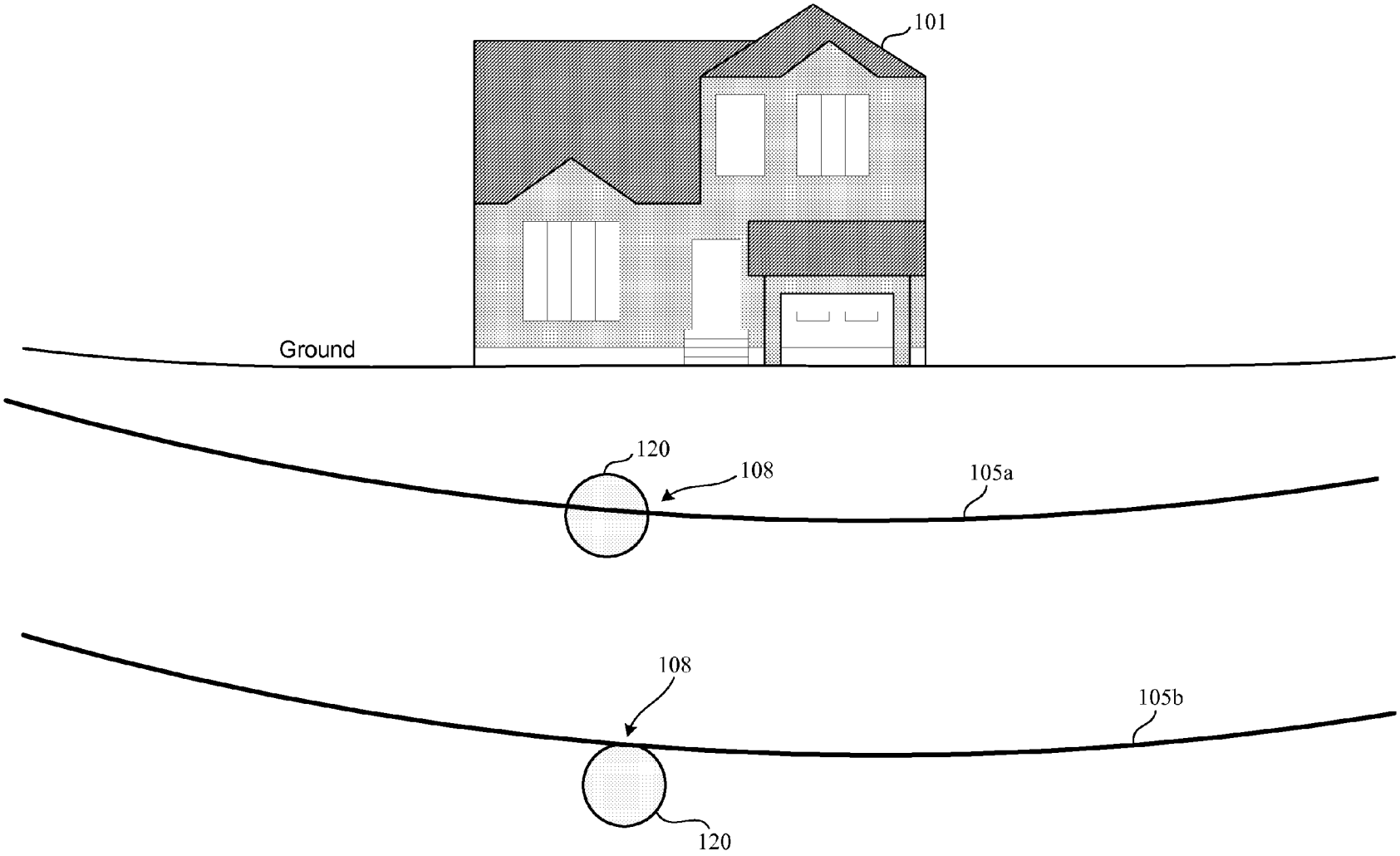
FIG. 1 shows a residential house provided with gas, water, electrical, communications, and sewer services, including a sewer lateral and two different types of cross bores in accordance with various embodiments.

In the following description of the illustrated embodiments, references are made to the accompanying drawings forming a part hereof, and in which are shown by way of illustration, various embodiments by which the invention may be practiced. It is to be understood that other embodiments may be utilized, and structural and functional changes may be made without departing from the scope of the present invention.

Systems, devices or methods according to the present invention may include one or more of the features, structures, methods, or combinations thereof described herein. For example, a device or system may be implemented to include one or more of the advantageous features and/or processes described below. It is intended that such a device or system need not include all of the features described herein, but may be implemented to include selected features that provide for useful structures, systems, and/or functionality.

A variety of trenchless excavation technologies have been developed to increase the installation efficiency of various underground utilities. Horizontal direction drilling (HDD), for example, is increasingly being used for utility line installations. Other popular trenchless excavation technologies include percussive moles and plowing. In general, trenchless excavation technologies have the advantage of not being disruptive to the surface, yards, roads, driveways, traffic and trees, for example, but have the disadvantage of not allowing installers to actually see where utility lines are being installed.

A particularly concerning situation arises when a new utility is to be installed in a subsurface where an existing underground utility is located. In this scenario, a cross bore may arise. A cross bore is generally understood in the industry as an intersection of an existing underground utility or underground structure by a second utility resulting in direct contact between the transactions of the utilities that can compromise the integrity of either utility or underground structure.

By way of example, it sometimes occurs that a utility installation contractor using an HDD machine to install a gas service line inadvertently drills through or very near a main sewer or sewer lateral pipe and unknowingly installs a gas supply pipeline through or in contact with the sewer pipe. This direct or proximal unintended contact between underground utilities represents a cross bore. At some later date when a back-up occurs in the sewer, the owner might engage a sewer cleaner using a cutter device to clear the sewer. This can lead to a breach in the gas line and subsequent ignition of the gas which flows into the sewer line.

It can be appreciated that installing new utilities within a subsurface that includes legacy utilities is problematic in cases where the location, size, orientation, type, material, and other characteristics of such legacy utilities are either uncertain or unknown. Sewer authorities presently complain that newly constructed sewer lines are being damaged when underground utility lines are installed, and utility installers presently complain that sewers are not properly located or their locations are not accurately documented.

Results of numerous legacy verification projects indicate that, in high risk areas having suspected cross bores, the number of cross bores found per mile of main sewer inspected have been between 2 and 3. For example, testing in the field using CCTV (closed circuit television) cameras to check a series of laterals nearby new gas service installations indicates that there could be two cross bores per mile of main sewer in any area where horizontal drilling has been used to install the gas service.

In view of the many thousands of miles of sewers situated where utility lines have been installed with trenchless technologies, there may exist a legacy of at least thousands of cross bores of gas supply pipelines alone in sewers. In addition to gas explosion concerns, damage done to existing utilities due to cross bores is dramatic. For example, holes broken into sewers increases infiltration and inflow of water into sewers, creating structural deficiencies that may eventually create sinkholes and voids that may be extremely expensive to repair.

Systems and methods of the invention are directed to monitoring for legacy cross bores. Systems and methods of the invention are directed to detecting legacy cross bores. Embodiments of the invention are directed to apparatuses and methodologies that facilitate cost effective monitoring and locating of legacy cross bores. Cross bore monitoring data may be collected and analyzed to determine the presence of cross bores. Cross bore monitoring data may be used to detect suspect cross bores that may be subsequently verified by contractors using conventional techniques, such as CCTV cameras. Cross bore monitoring data may be incorporated in a utility mapping database and/or a geographic information system (GIS). Suspected and verified cross bore information may be incorporated, updated, and managed using the utility mapping database and/or GIS.

According to various embodiments of the invention, a small acoustic vibrator, shaker, or seismic generator is coupled to a gas supply pipeline, such as onto the gas riser pipe on the street side of the gas meter at each home or other service location on a city block. In cases where the gas meter is located in a basement, the acoustic or seismic generator can be coupled to the gas supply pipeline at a curb stop or valve box. The number of signal generators in a city block or portion thereof may correspond to the number or gas supply pipelines that service these homes. For example, there may be up to sixteen or more service connections per block.

In one approach, all of the signal generators are activated (manually or wirelessly) for a city block or block portion, such that all generators are imparting their signal to their respective gas supply pipelines. A listening device (e.g., a microphone, acoustic receiver, seismic receiver) is pulled or pushed through the main sewer in the street searching for the transmitted frequency or frequencies emanating from a sewer lateral connection to the main sewer. If there is no cross bore present, no significant signal will be detected in the main sewer. If a cross bore does exist, the space in the lateral, whether filled with air or water, will convey the transmitted acoustic frequency down the lateral to the main sewer where it will be detected by the listening device.

The signal generators may be configured to transmit either a monochromatic frequency or a sweep of frequencies. A frequency sweep approach allows effective transmission of the signal even if there are changes in soil type and pipe length or if the pipe is filled with water instead of air.

In some embodiments, the listening device is conveyed through the main sewer line using a fiberglass rod or some other small diameter rod, pipe, cable, line or tether. The listening device may be equipped with a floatation arrangement or kite that allows the listening device to be carried by a flow within the main sewer. This approach advantageously allows for cross bore detection without having to first clean or clear the sewer as might be the case in order to use a CCTV camera conveyed by a wheeled or track robot. As the listening device is moved past a lateral, the device monitors for any evidence of the acoustic signal generated at the service connection that is emanating from the lateral connection into the main sewer. The monitoring data can be recorded on-board and/or transmitted to an above-ground device via a hardwire or wireless connection (e.g., rod conductor or via a sonde).

Embodiments of the invention are directed to systems and methods that allow users to clear as many sites as possible quickly and cost effectively. Embodiments of the invention provide a viable solution to the present problem of having to inspect many thousands of potential legacy cross bore locations, which is not practicable using conventional approaches. In the event a cross bore is detected, such as at a lateral or area of a city block suspected of having a cross bore, then a more definitive investigative approach, such as CCTV or surface geophysics, can be employed to locate the cross bore in order to repair it.

Turning now to FIG. 1, there is illustrated a residential house 101 representative of a typical home in a city or suburb that is provided with gas, water, electrical, communications, and sewer services. FIG. 1 shows a cross section of the subsurface between the house 101 and the street (not shown). The subsurface is shown to include a sewer lateral 120 and two different types of cross bores 108. The upper cross bore 108 was formed by trenchless drilling of a bore 105*a* that penetrated through the lateral 120 and subsequently installing a gas supply pipeline in the bore 105*a*. The lower cross bore 108 was formed by trenchless drilling of a bore 105*b* which came into contact with, or was very close to, the lateral 120 and subsequently installing a gas supply pipeline in the bore 105*b*. In either scenario, the unintended installation of a gas supply pipeline within or in close contact with the sewer lateral 120 results in a cross bore 108 at this home location.

Figure 2:
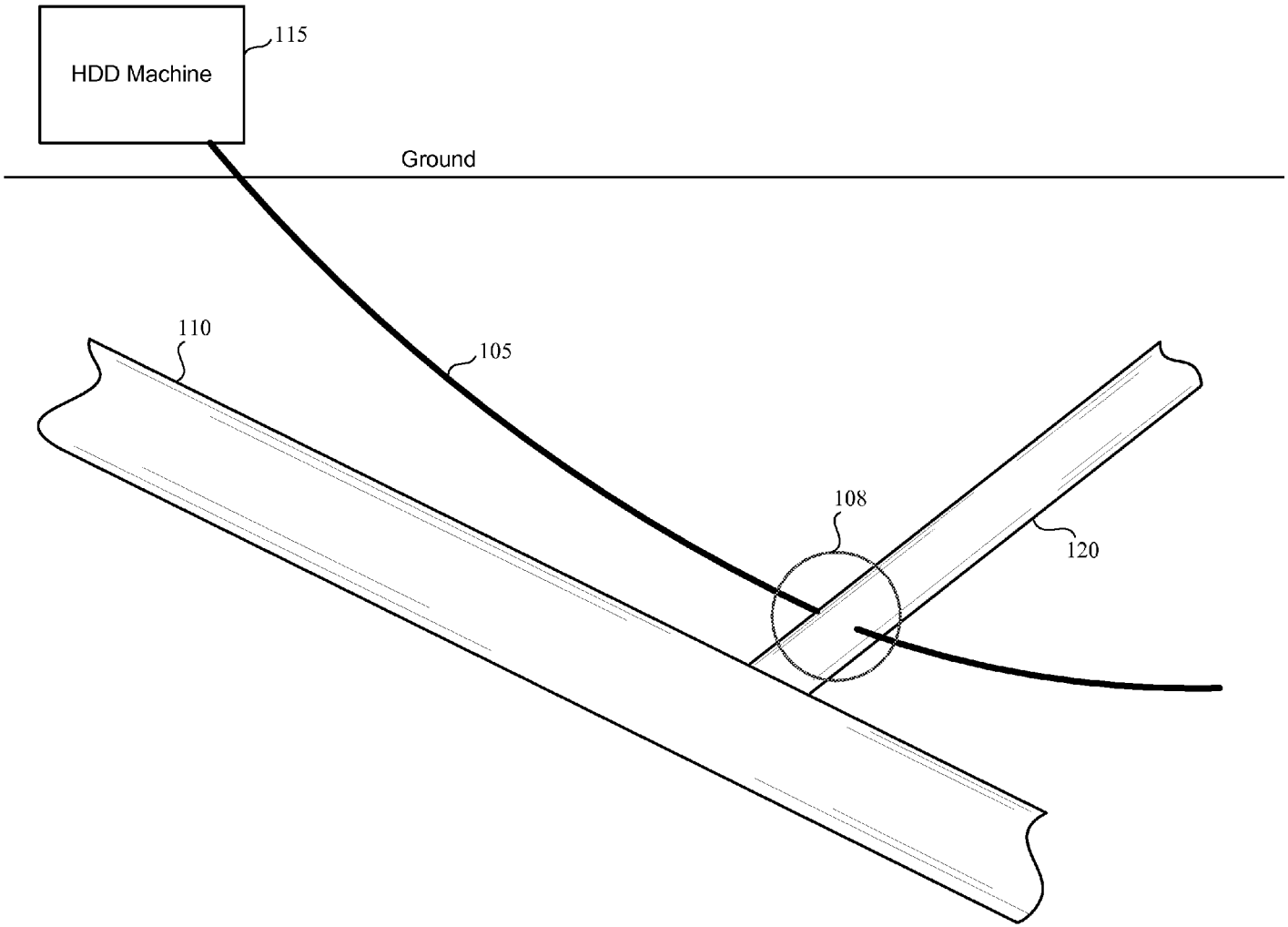
FIG. 2 shows a horizontal directional drilling (HDD) machine used to create a pilot bore into which a gas supply pipeline for a home is installed in accordance with various embodiments.

As is shown in FIG. 2, an HDD machine 115 is often used to create a pilot bore 105 into which a gas supply pipeline for a home is installed. When installing the gas supply pipeline, a back reamer is often used, which generally expands the diameter of the pilot bore 105*a*, 105*b* as the back reamer is pulled back through the pilot bore, along with the gas pipeline, using the HDD machine 115. Contact between the back reamer and the lateral 120 generally increases the severity of damage imparted to the lateral 120. The cross bore 108 can remain undisturbed and undetected for many years. However, a later attempt to clear the sewer lateral can disturb the gas supply pipeline at the cross bore, which can lead to a dangerous and life threatening explosion of built-up gas within the lateral.

Figure 3:
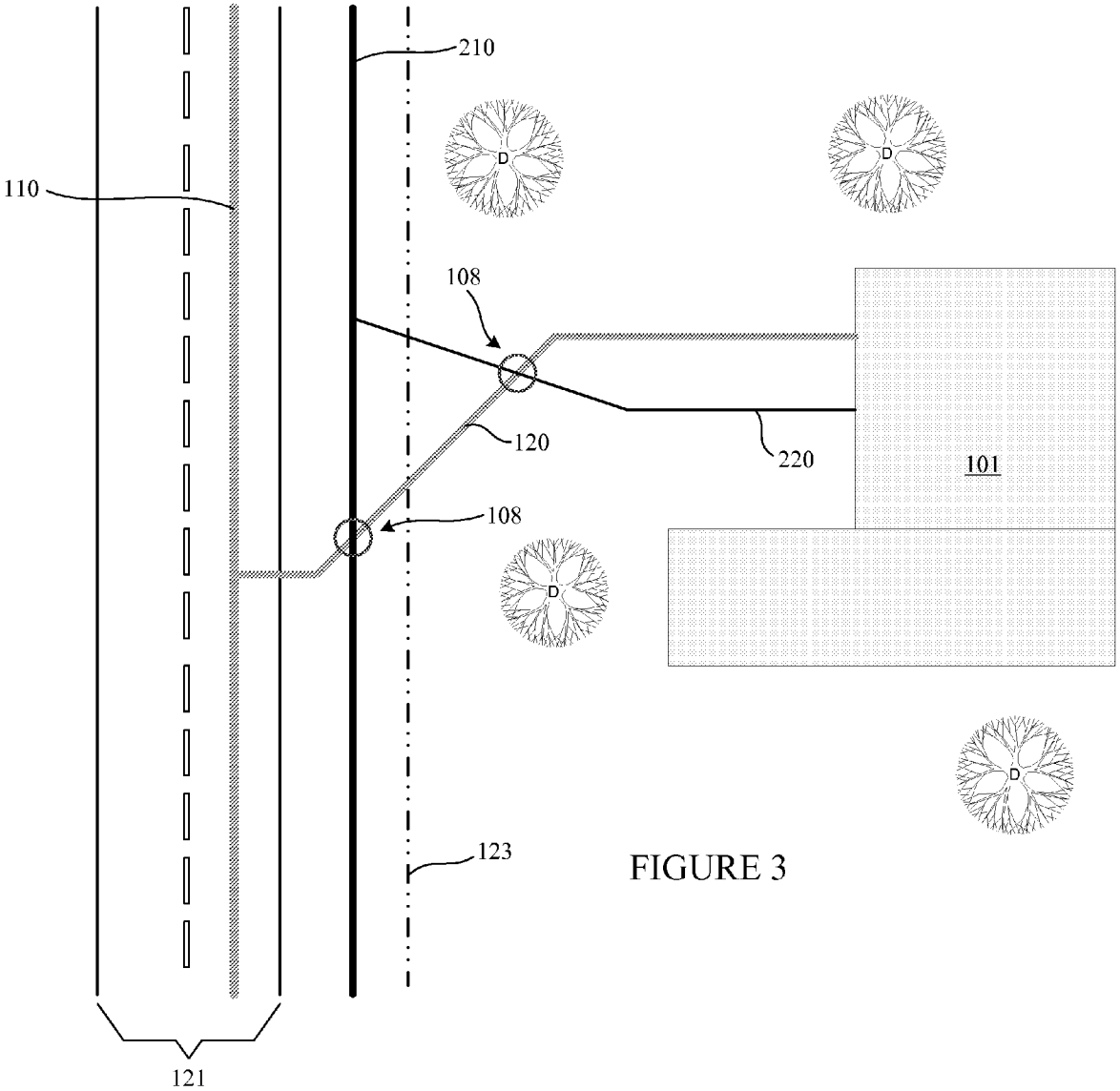
FIG. 3 shows a plan view of a house located in a neighborhood having a main sewer, a gas main, and two potential cross bores in accordance with various embodiments.

FIG. 3 shows a plan view of a house 101 located in a neighborhood having a main sewer 110 buried beneath a street 121 and a gas main 210 buried between the street 121 and the property line 123 of the house 101. In FIG. 3, two potential cross bores 108 are illustrated. The first cross bore 108 is shown at an intersection between the gas supply pipeline 220 and a sewer lateral 120. The second cross bore 108 is shown at an intersection between the sewer lateral 120 and the gas main 110.

Figure 4A:
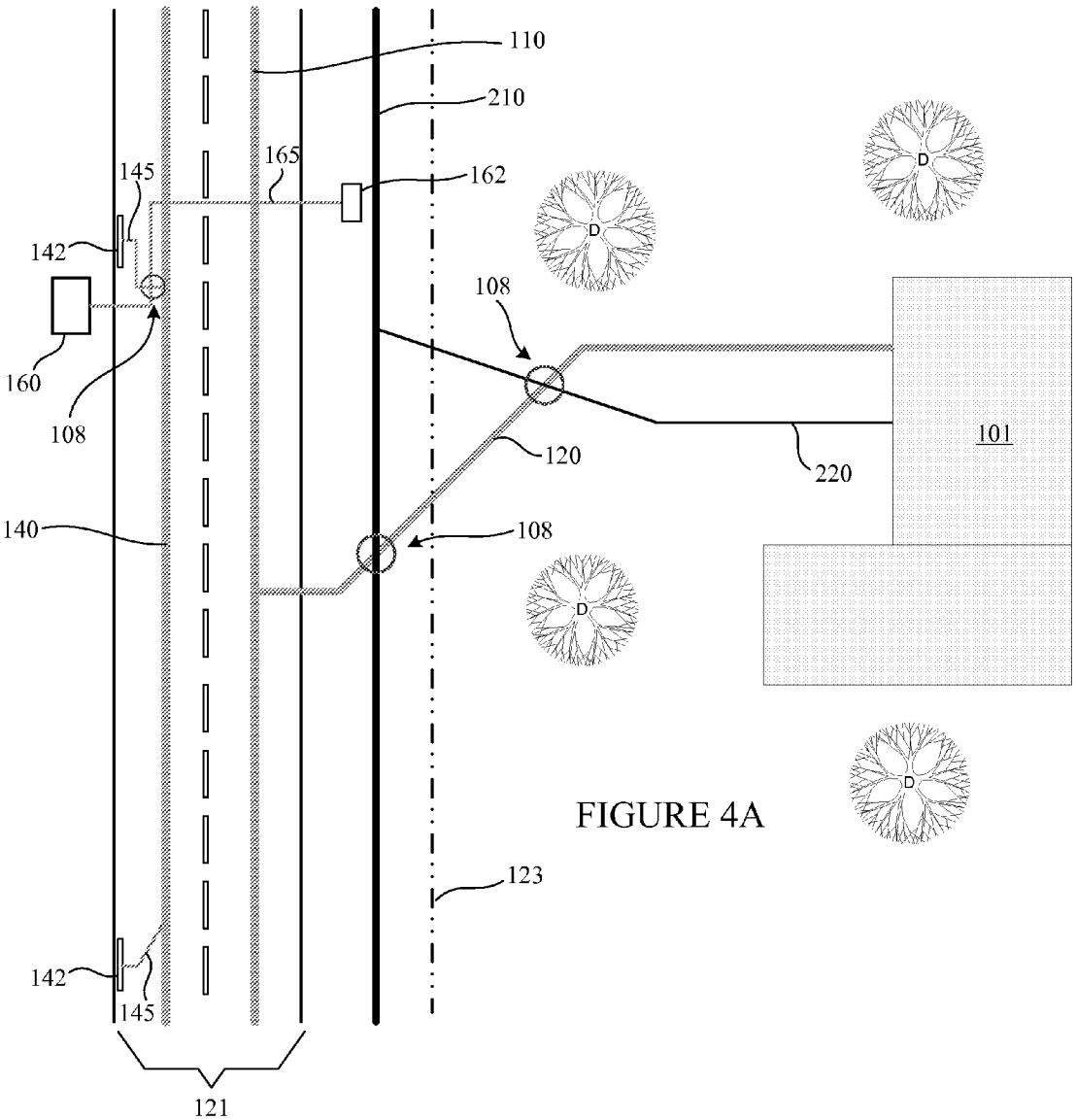
FIG. 4A shows a plan view of a house located in a neighborhood having a main sewer, a gas main, a storm pipe, a series of storm drains connecting to respective storm pipe laterals, and different types of potential cross bores in accordance with various embodiments.
Figure 4B:
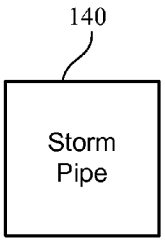
FIGS. 4B and 4C show different cross sectional shapes for different types of sewers and storm pipes in accordance with various embodiments.
Figure 4C:
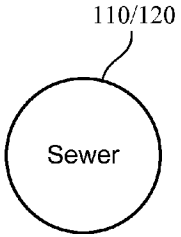

FIG. 4A shows a plan view of a house 101 located in a neighborhood having a main sewer 110 buried beneath a street 121, a gas main 210 buried between the street 121 and the property line 123 of the house 101, and a storm pipe 140 also buried beneath the street 121. The storm pipe 140 is connected to a series of storm drains 142 via respective storm pipe laterals 145. It is noted that sanitary sewers 110/120 and storm pipes 140 (also referred to herein as storm sewers) generally have different cross sectional shapes, as is shown in FIGS. 4B and 4C. It is understood that the term sewer is intended to represent a variety of different fluid carrying conduits that are buried and also open to the atmosphere. Sanitary sewers, storm pipes, and their respective laterals represent a non-exclusive listing of sewers that are contemplated.

In FIG. 4A, three potential cross bores 108 are illustrated. The first two are the same as those discussed above with reference to FIG. 3. The third cross bore involves an intersection between a storm pipe lateral 145 and a utility 165. The utility 165 is shown buried beneath the street 121 and extends between first and second utility boxes 160, 162. The utility 165 represents any type of utility, such as a gas, water, electrical (e.g., power), communications (e.g., cable, telephone, optical fiber), or sewer utility.

Figure 5:
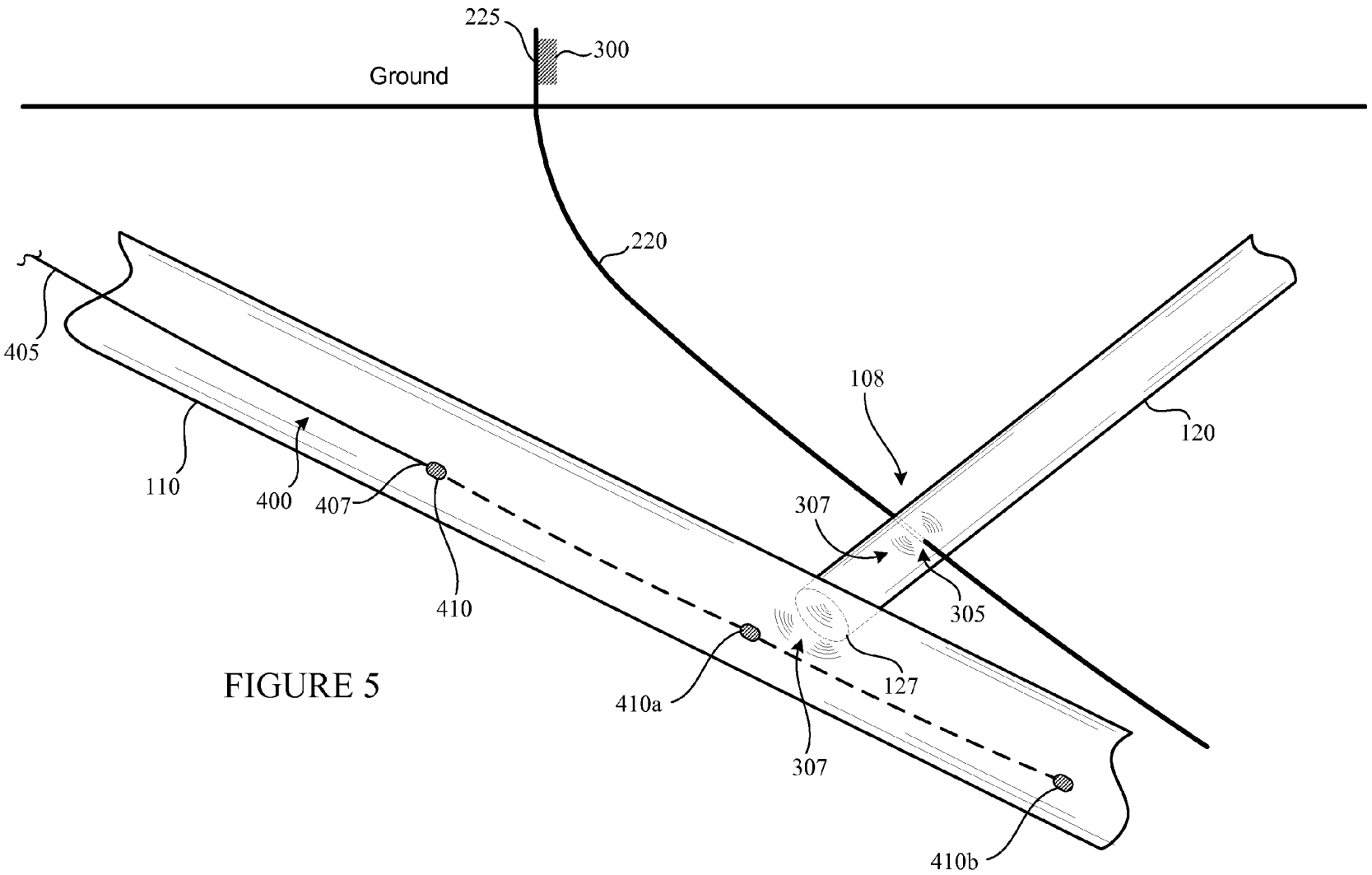
FIGS. 5 and 6 illustrate a cross bore detection system and method in accordance with various embodiments.
Figure 6:
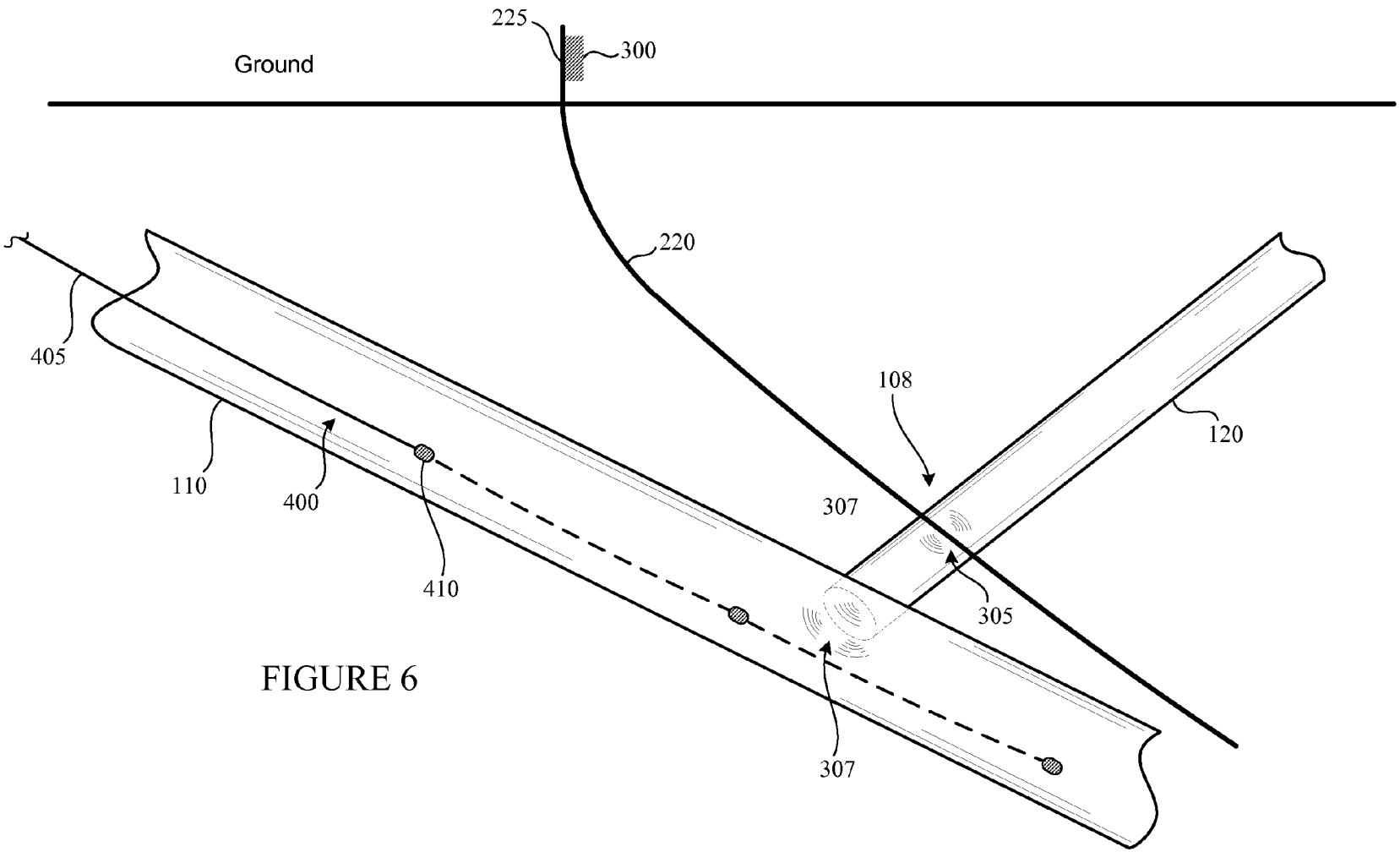

FIGS. 5 and 6 illustrate a cross bore detection system and method in accordance with embodiments of the invention. In FIGS. 5 and 6, a cross bore 180 is illustrated at an intersection between a gas supply pipeline 220 for a residential home and a sewer lateral 120 that connects with a main sewer 110. In FIG. 5, the cross bore 180 penetrates the sewer lateral 120 due to a bore created through the lateral 120. The cross bore shown in FIG. 5 can result from back reamer contact with the lateral 120 during gas supply pipeline installation. Such contact can cause a breach in the wall of the lateral 120, which can result in exposure of the gas supply pipeline 220 within the lateral wall breach.

In FIG. 6, the cross bore 180 brings the gas supply pipeline 220 into direct or close proximal contact with the lateral 120.

In this configuration, the gas supply pipeline 220 can be disrupted from within the lateral 120 (e.g., such as by clearing or cutting activity), allowing gas to flow from the gas supply pipeline 220 and into the lateral 120. The gas supply pipeline 220 can also be disrupted when accessing the exterior of lateral 120, such as for repairing or replacing the lateral 120.

An acoustic or seismic signal source apparatus 300 is shown mounted to the gas supply pipeline 220, preferably at a gas riser, curb stop, or a valve box location. The signal source apparatus 300 generates a source signal that is communicated to the gas supply pipeline 220 and propagates along the gas supply pipeline 220. The portion of the gas supply pipeline 220 located at the cross bore 180 acts as a resonator or an extraction location that allows the source signal to propagate through the sewer lateral 120. The sewer lateral 120 acts as a waveguide, directing the source signal emanating from the gas supply pipeline 220 to the main sewer 110.

A receiver apparatus 400 (e.g., a listening device) is moved through the main sewer 110 with the signal source apparatus 300 actively generating the source signal. The receiver apparatus 400 includes a receiver unit 410 and a transport arrangement or member 405. The transport arrangement or member 405 is configured to facilitate movement of the receiver apparatus 400 through the main sewer 100 from an access location such as a manhole. As is shown in FIGS. 5 and 6, the receiver unit 410 monitors for the source signal as it travels down the main sewer 110.

As the receiver unit 410 approaches the sewer lateral connection 127, the receive unit 410 senses the source signal emanating from the sewer lateral 120, indicating the presence of a cross bore involving the gas supply pipeline 220 and the sewer lateral 120. As the receiver unit 410 progresses away from the sewer lateral 120, the source signal strength falls off, and the receiver unit 410 continues to monitor for cross bores involving downstream laterals. Monitoring data (e.g., presence or absence of signal source reception information) acquired by the receiver unit 410 is preferably recorded in a memory of the receive unit 410. Alternatively or additionally, monitoring data may be transmitted to an above-ground device, such as a field laptop or other reception device. The receiver unit 410 may progress downstream or upstream of the flow through the main sewer 110.

Figure 7:
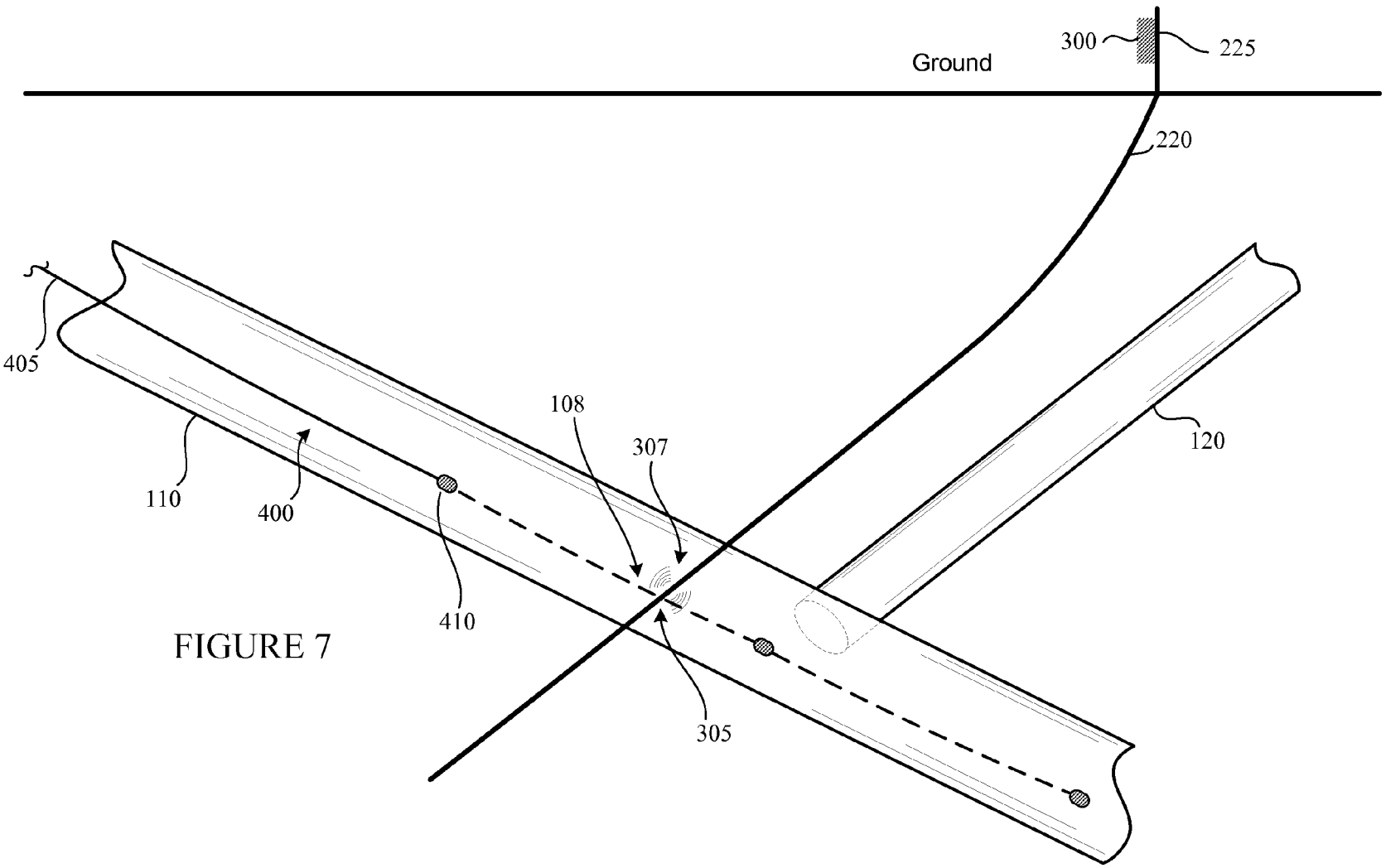
FIG. 7 shown a cross bore at an intersection of a gas supply pipeline and a main sewer in accordance with various embodiments.

FIG. 7 shown a cross bore at an intersection of the gas supply pipeline 220 and the main sewer 110. The methodology for detecting a cross bore in a sewer lateral 120 is applicable to the detection of a cross bore in the main sewer 110.

The receiver unit 410 includes an acoustic or seismic receiver, and the transport arrangement or member 405 may include a wire, a cable, a tether, a polymeric line, a fiberglass line, or a pushrod, for example. In some embodiments, the transport apparatus 405 includes a pushrod comprising one or more conductive wires that facilitate tracing of non-metallic utilities. The transport arrangement or member 405 may include a kite or float that allows the receiver unit 410 to be carried with the flow through the main sewer 110 at or below the fluid level (e.g., submerged or floating) within the main sewer 110. A coupler is used to couple the receiver unit 410 to the transport arrangement or member 405, which may be configured to allow easy detachment of the receiver unit 410 from the transport arrangement or member 405.

Figure 8:
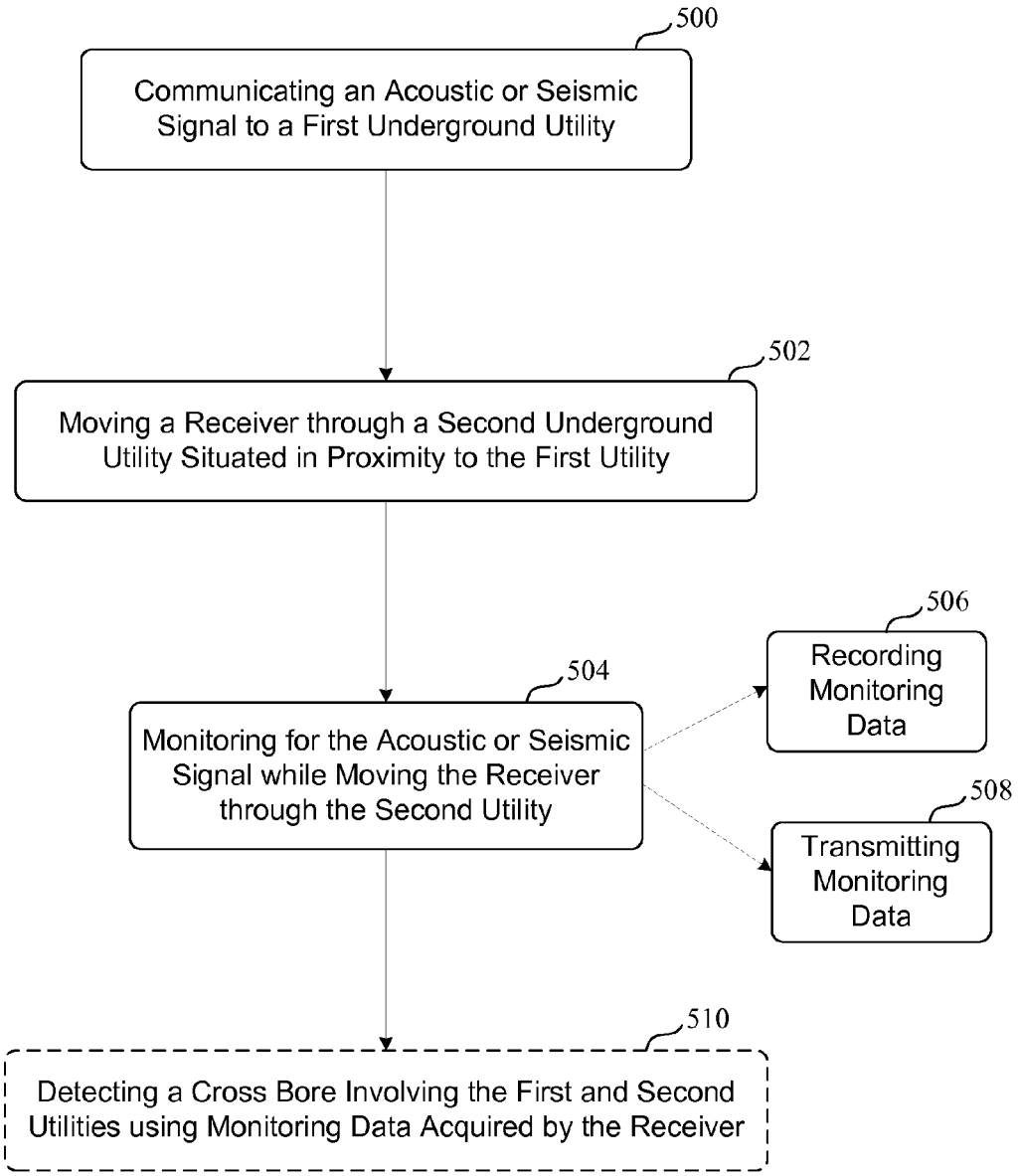
FIGS. 8-11 are flow diagrams showing various processes of cross bore detection methodologies in accordance with in accordance with various embodiments.

FIG. 8 is a flow diagram showing various processes of a cross bore detection methodology in accordance with embodiments of the invention. According to FIG. 8, an acoustic or seismic source signal is generated and communicated 500 to a first underground utility. A receiver is moved 502 through a second underground utility situated in proximity to the first utility. The receiver monitors 504 for a cross bore involving the first and second utilities in response to receiving the source signal emanating from the first utility as the receiver progresses through the second utility. Monitoring data is recorded 506 and may alternatively or additionally be transmitted 508 to a surface location. A cross bore involving the first and second utilities is detected 510 using the monitoring data acquired by the receiver. Cross bore detection may be performed using a processor of a surface computer (e.g., field laptop), a networked processor, or a process on-bored the receiver.

Various techniques may be used to detect presence of a cross bore using the monitoring data. For example, a threshold signal amplitude (e.g., signal-to-noise ratio) may be used to distinguish between noise and sensing of the source signal. Frequency analysis may also be used to distinguish between noise and sensing of the source signal. In embodiments that provide encoding or modulation of the source signal, detection of data impressed in the source signal can be used to distinguish between noise and sensing of the source signal.

Figure 9:
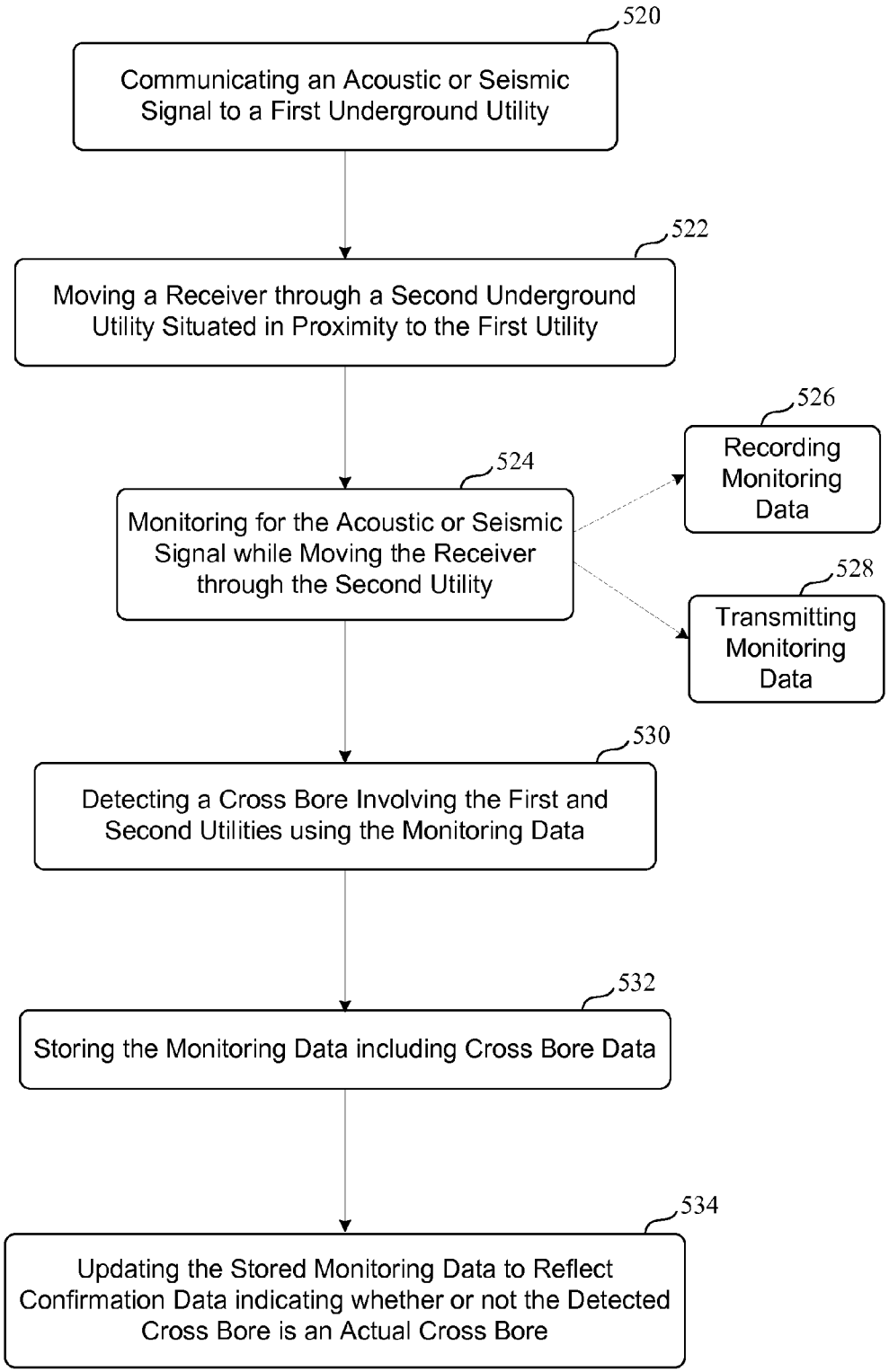

FIG. 9 is a flow diagram showing various processes of a cross bore detection methodology in accordance with embodiments of the invention. According to FIG. 9, an acoustic or seismic source signal is generated and communicated 520 to a first underground utility. A receiver is moved 522 through a second underground utility situated in proximity to the first utility. The receiver monitors 524 for a cross bore involving the first and second utilities in response to receiving the source signal emanating from the first utility as the receiver progresses through the second utility. Monitoring data is recorded 526 and may alternatively or additionally be transmitted 528 to a surface location. A suspected cross bore involving the first and second utilities is detected 530 using the monitoring data acquired by the receiver. The monitoring data is stored 532, including the suspected cross bore data. The suspected cross bore is verified, such as by use of a CCTV camera. The stored monitoring data is updated 534 to reflect confirmation data indicating whether or not the suspected cross bore is an actual cross bore.

Figure 10:
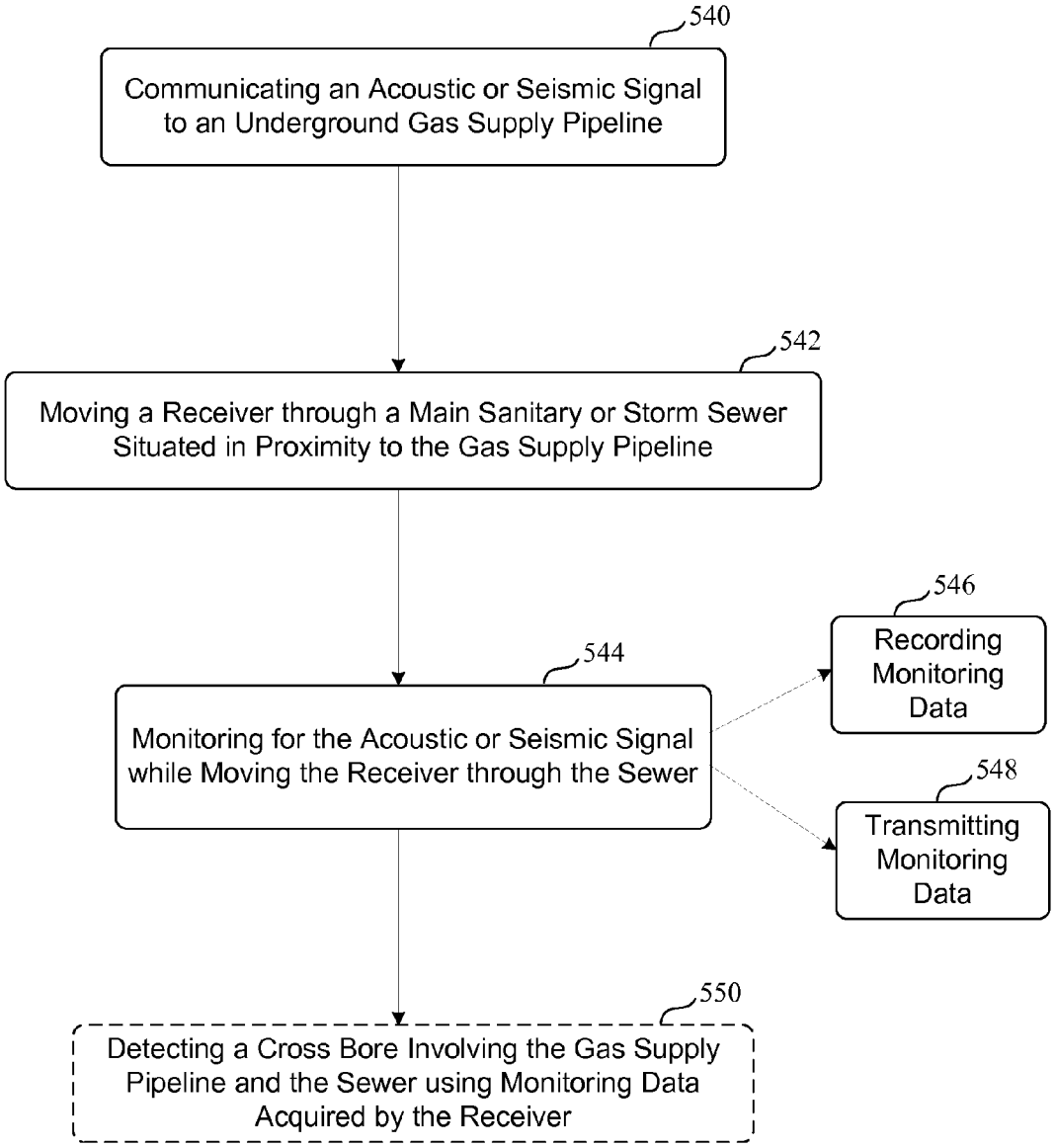

FIG. 10 is a flow diagram showing various processes of a cross bore detection methodology in accordance with embodiments of the invention. According to FIG. 10, an acoustic or seismic source signal is generated and communicated 540 to an underground gas supply pipeline. A receiver is moved 542 through a main sanitary or storm sewer situated in proximity to the gas supply pipeline. The receiver monitors 544 for a cross bore involving the gas supply pipeline and sewer in response to receiving the source signal emanating from the gas supply pipeline as the receiver progresses through the sewer. Monitoring data is recorded 546 and may alternatively or additionally be transmitted 548 to a surface location. A cross bore involving the gas supply pipeline and the sewer is detected 550 using the monitoring data acquired by the receiver.

Figure 11:
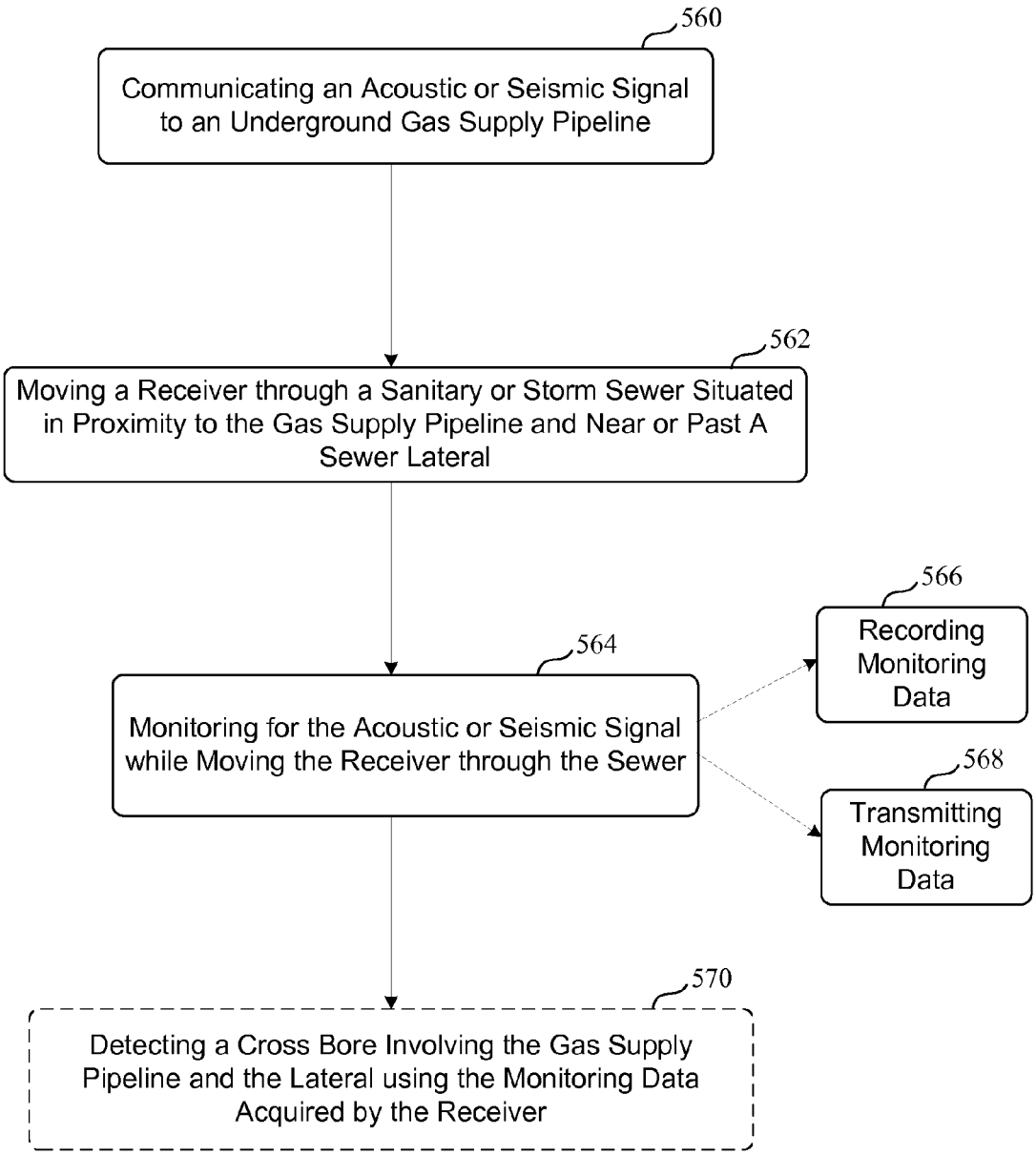

FIG. 11 is a flow diagram showing various processes of a cross bore detection methodology in accordance with embodiments of the invention. According to FIG. 11, an acoustic or seismic source signal is generated and communicated 560 to an underground gas supply pipeline. A receiver is moved 562 through a main sanitary or storm sewer situated in proximity to the gas supply pipeline and near or past a lateral of the sewer. The receiver monitors 564 for a cross bore involving the gas supply pipeline and the sewer lateral in response to receiving the source signal emanating from the gas supply pipeline as the receiver progresses through the sewer. Monitoring data is recorded 566 and may alternatively or additionally be transmitted 568 to a surface location. A cross bore involving the gas supply pipeline and the sewer lateral is detected 570 using the monitoring data acquired by the receiver.

Figure 12:
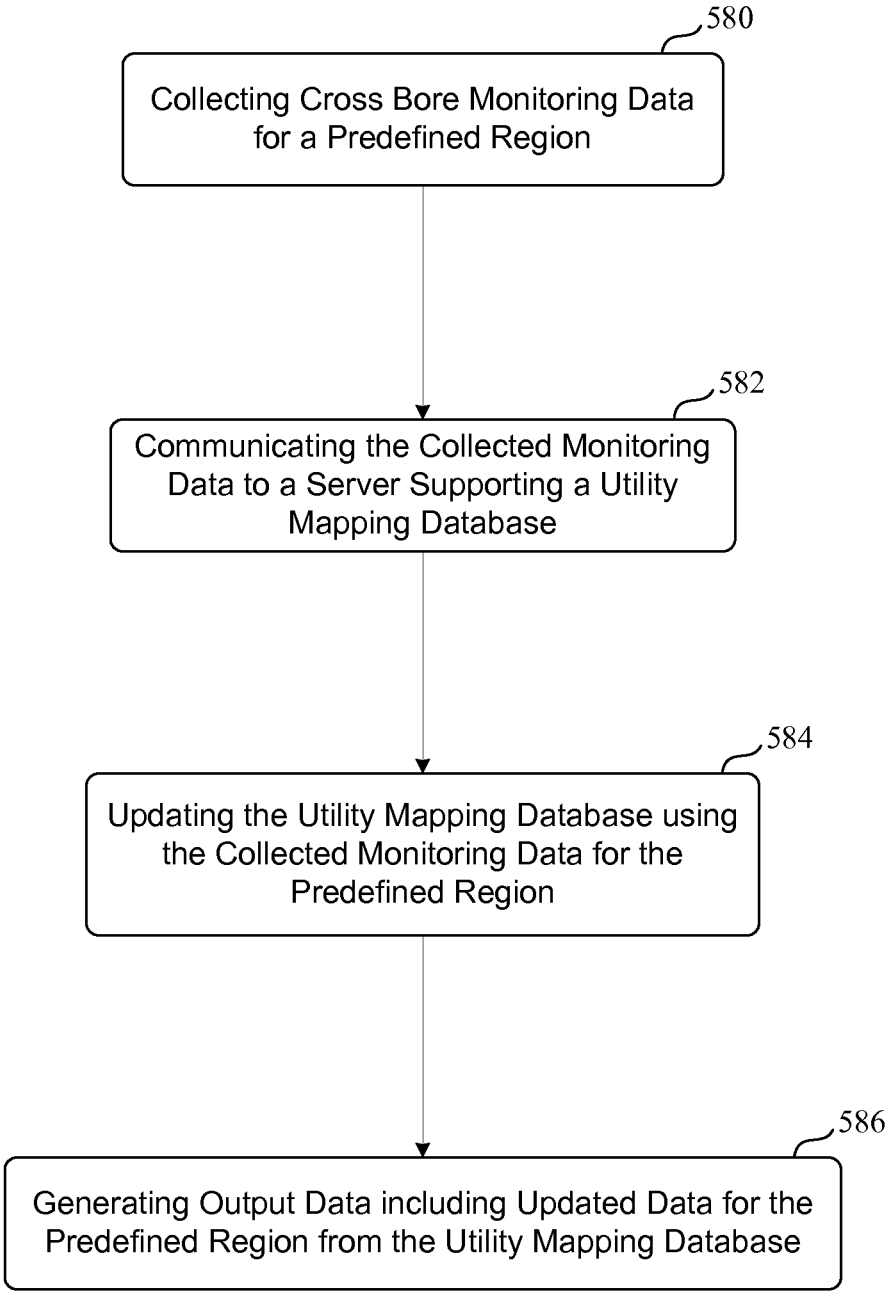
FIGS. 12 and 13 are flow diagrams showing various processes involving collection and management of cross bore detection data in accordance with various embodiments.

FIG. 12 is a flow diagram showing various processes involving collection and management of cross bore detection data in accordance with embodiments of the invention. According to FIG. 12, cross bore monitoring data is collected 580 for a predefined region, such as a city block or portion of a city block. The collected monitoring data is communicated 582 to a server that supports a utility mapping database. The utility mapping data is updated 584 using the collected monitoring data for the predefined region. Output data is generated 586 that includes updated data for the predefined region from the utility mapping database, typically by a remote user.

Figure 13:
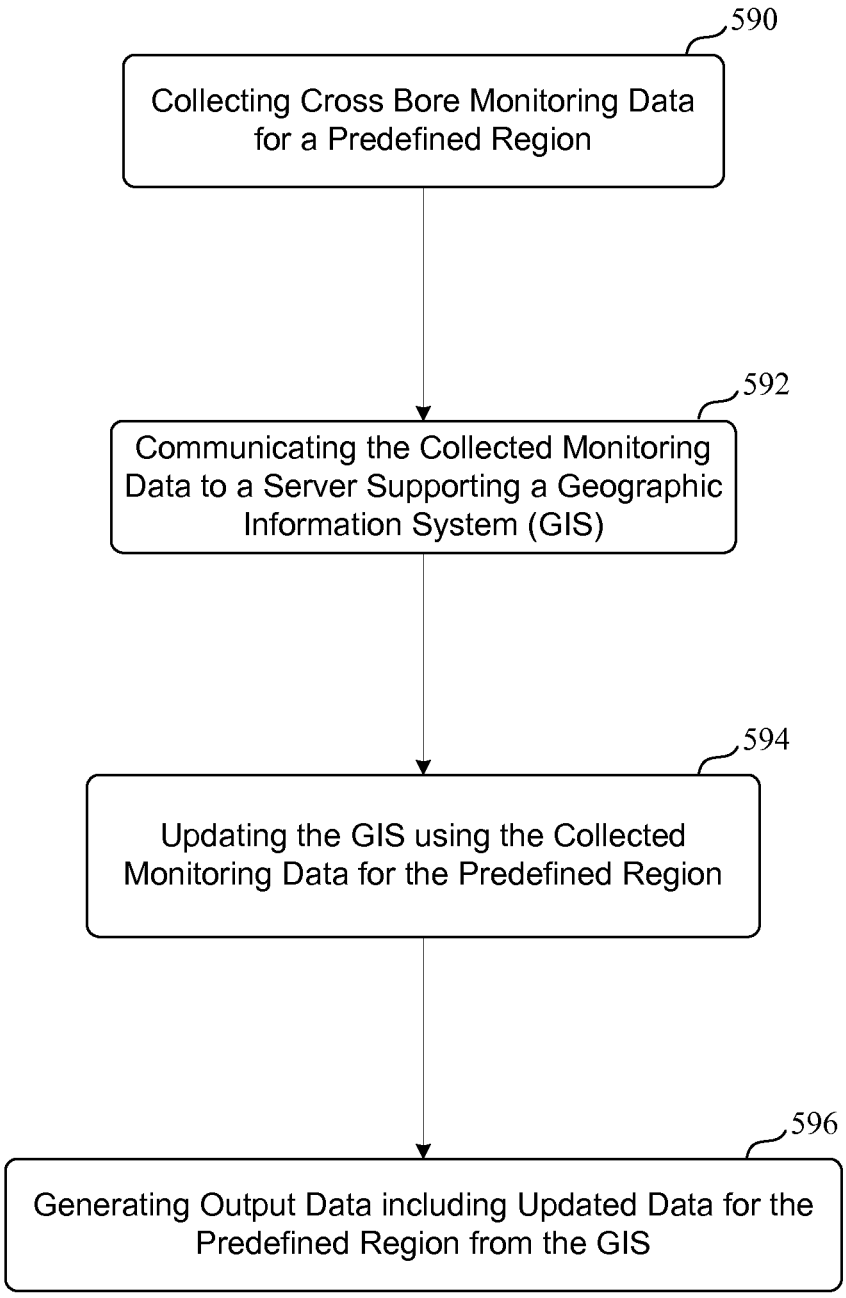

FIG. 13 is a flow diagram showing various processes involving collection and management of cross bore detection data in accordance with embodiments of the invention. According to FIG. 13, cross bore monitoring data is collected 590 for a predefined region, such as a city block or portion of a city block. The collected monitoring data is communicated 592 to a server that supports a geographic information system. The GIS is updated 594 using the collected monitoring data for the predefined region. Output data is generated 596 that includes updated data for the predefined region from the GIS, typically by a remote user. Additional details for managing utility mapping and GIS data in the context of various embodiments of the invention are disclosed in commonly owned U.S. Pat. No. 6,751,553, which is incorporated herein by reference.

FIG. 14 illustrates a network of signal source apparatuses 300 deployed for a number of buildings (e.g., homes, office buildings, etc.) located within a city block or other predefined region 600. A signal source apparatus 300*a-n* is mounted to each gas supply pipeline 220 for each of the buildings 101*a-n*. Each of the buildings 101*a-n* has a sewer lateral 120 connected to a main sewer 110. A cross bore can be seen at an intersection of the gas supply pipeline 220 and sewer lateral 120 for building 101*c*.

Figures 14A, 14B:
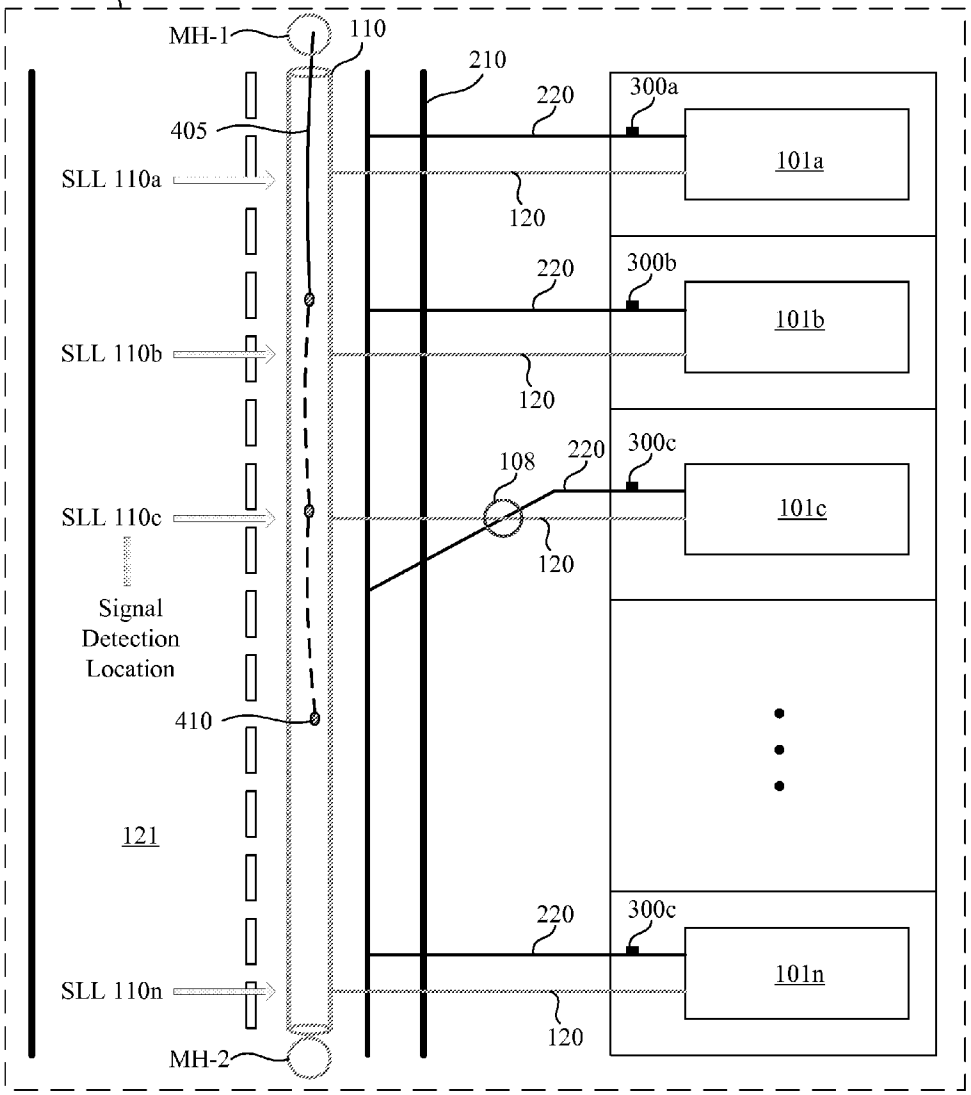
FIGS. 14A and 14B illustrate a network of signal source apparatuses deployed for a number of buildings located within a city block or other predefined region in accordance with various embodiments.

As is further shown in FIG. 14A, a receiver unit 410 is moved through the main sewer between manholes MH-1 and MH-2. Situated between manholes MH-1 and MH-2 are several sewer laterals 120, including a lateral for building 101*c*. As the receiver unit 410 progresses along the main sewer 110, the receiver unit 410 records monitoring data, such as the illustrative data shown in FIG. 14B. As shown in the data table of FIG. 14B, source signal detection data is collected between manholes MH-1 and MH-2. The data shows no detection of a source signal for sewer lateral locations (SLL) 110*a* and 110*b* associated with buildings 101*a* and 101*b*. The distance traveled from a reference location, such as manhole MH-1, may be measured using an encoder coupled (e.g., physically, optically, or magnetically) to the transport line or member 405. Alternatively, a sonde can be affixed to the distal end of the transport member proximate the receiver unit 410. The sonde signal can be detected using an above-ground detector from which travel distance of the receiver unit 410 may be determined using known techniques.

The data table of FIG. 14B shows that a source signal was detected at SLL 110*c* associated with building 101*c*. The data table indicates that no other source signals were detected for other laterals located between manholes MH-1 and MH-2. Upon reviewing the collected monitoring data stored in the receiver unit 410, the cross bore associated with the lateral 120 for building 101*c* can be further investigated, such as by use of a CCTV camera tracker or robot. It is noted that the memory of the receiver unit 410 may take various forms, and may include a non-removable memory and/or a removable memory device, such as a memory card (SD card), a thumb drive, a magnetic hard drive, or an optical storage device.

Figure 15:
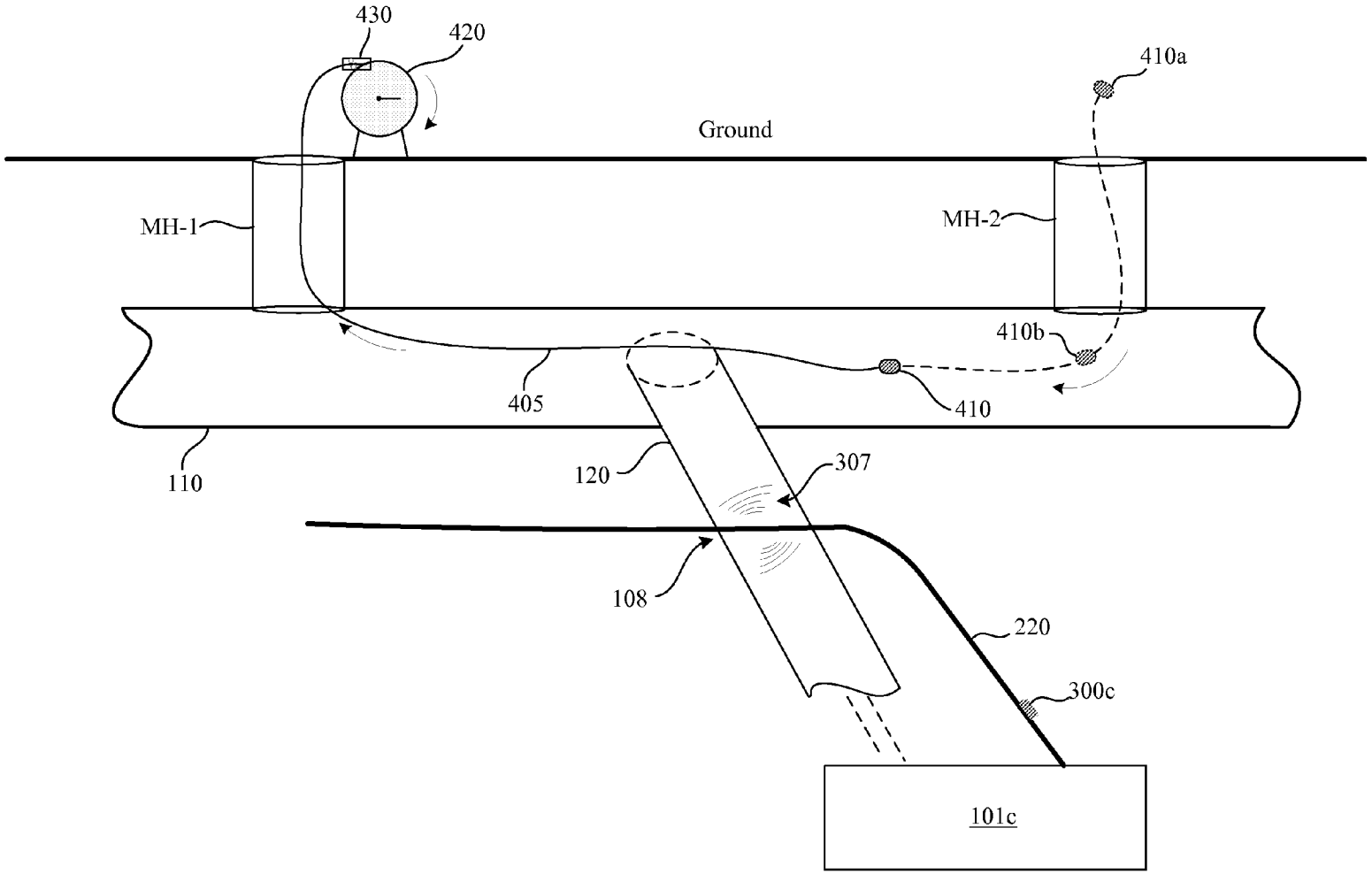
FIGS. 15 and 16 show various components of a system for detecting cross bores in accordance with various embodiments.
Figure 16:
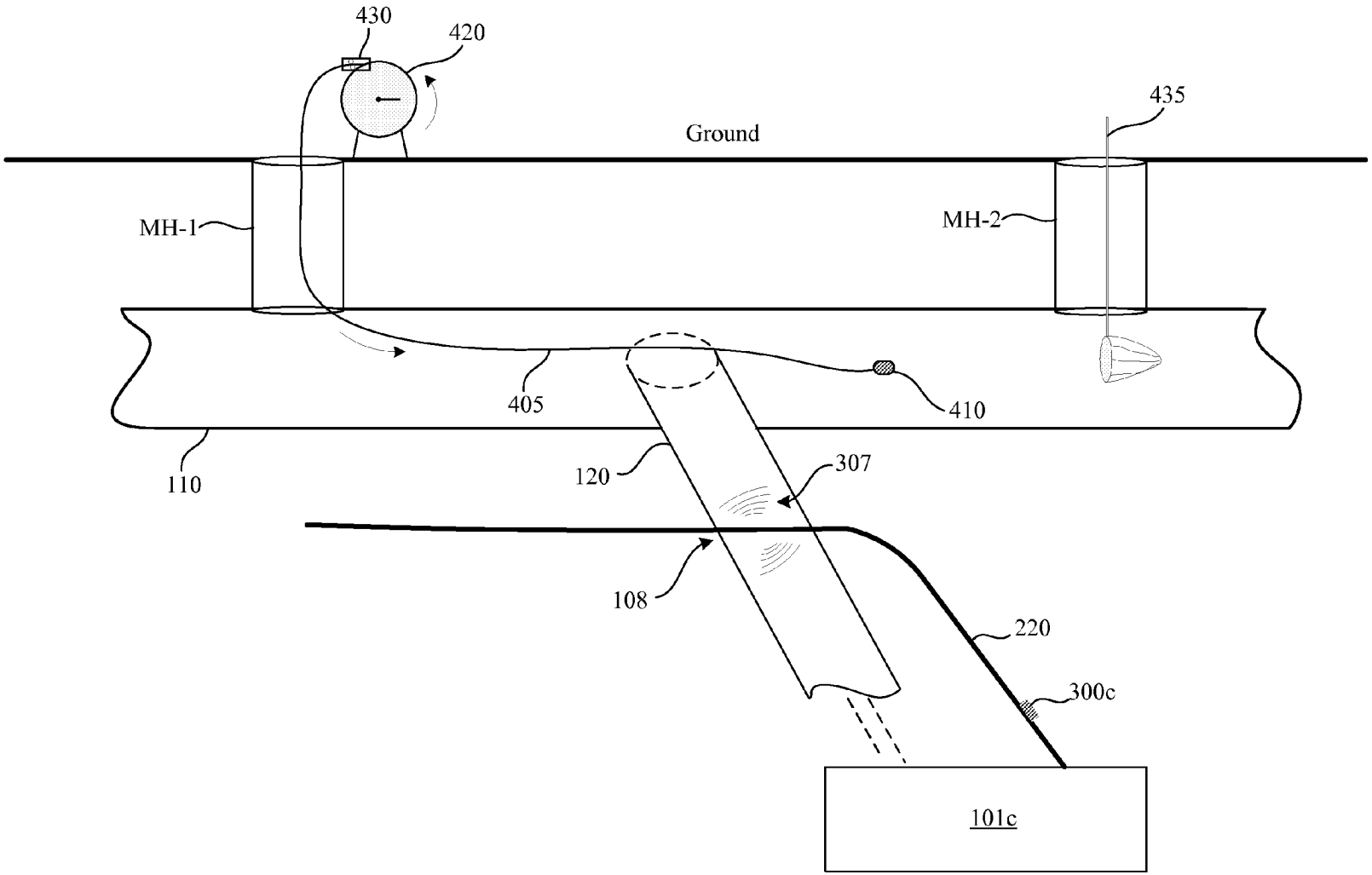

FIGS. 15 and 16 show various components of a system for detecting cross bores in accordance with embodiments of the invention. FIGS. 15 and 16 show a reel unit 420 around which a flexible line 405 is wound. The line 405 may be a wire, a cable, a tether, a polymeric line, a fiberglass line, or a flexible pushrod. For example, the line 405 may be a flexible fiberglass rod comprising one or more conductive wires. An encoder 430 may be used to measure the length of line 405 that is dispensed or reeled in.

According to the approach depicted in FIG. 15, the line 405 is floated down the sewer 110 from manhole MH-1 to downstream manhole MH-2. The line 405 is retrieved at manhole MH-2, and the receiver unit 410 is attached to a coupler of line 405 (shown by the receiver unit 410*a* depiction). The receiver unit 410 is lowered into the main sewer 110 (shown by the receiver unit 410*b* depiction), and reeled upstream using reel unit 420. Reel unit 420 may be manually or mechanistically driven and/or controlled. The receiver unit 410 collects monitoring data in the manner previously described.

In accordance with the approach depicted in FIG. 16, receiver unit 410 is floated down the sewer 110 from manhole MH-1 to downstream manhole MH-2. The line 405 is unreeled as the receiver unit 410 travels down the main sewer 110 past a number of laterals and collects monitoring data. The receiver unit 410 collects monitoring data in the manner previously described. The receiver unit 410 is retrieved at manhole MH-2 using a catch apparatus 435. The reel unit 420 may be manually or mechanistically driven and/or controlled.

Figure 20:
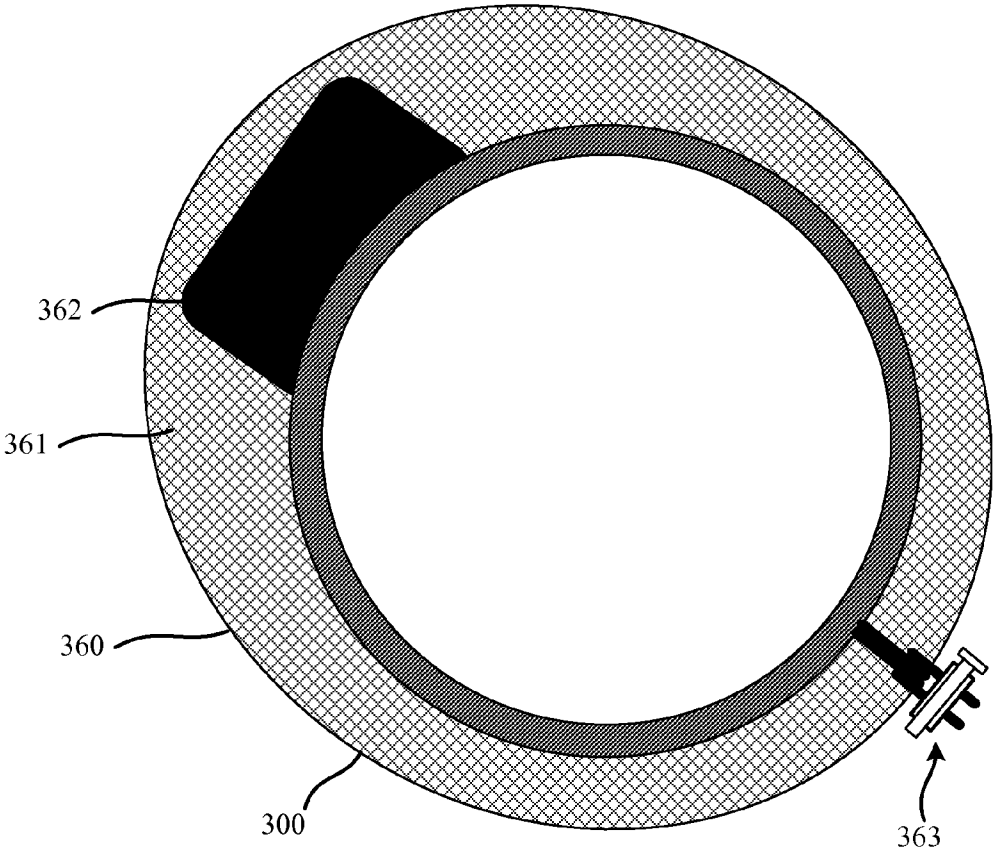
FIGS. 19 and 20 show configurations of a signal source apparatus in accordance with various embodiments.
Figure 19:
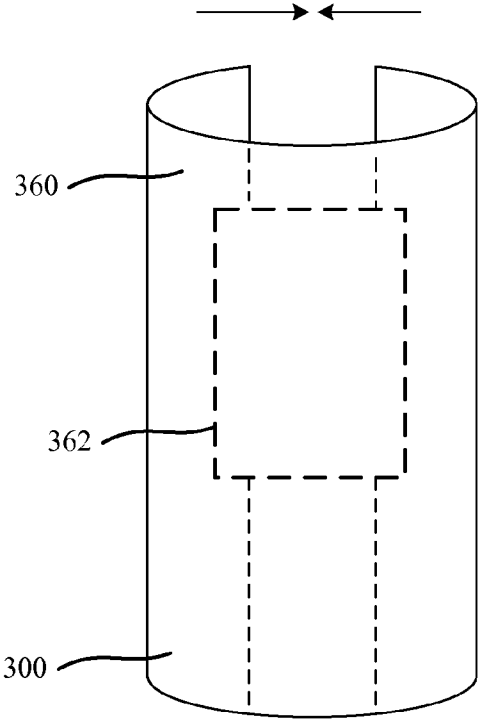

FIGS. 19 and 20 show configurations of a signal source apparatus 300 in accordance with embodiments of the invention. In FIG. 19, the signal source apparatus 300 includes a mounting arrangement 360 in the form of a cuff. The cuff may be formed from plastic, metal, a composite material or a combination of these and other materials. The mounting arrangement 360 supports a signal source unit 362 that is configured to generate an acoustic or seismic source signal. With the mounting arrangement 360 secured to a gas supply pipeline, the signal source unit 362 is positioned relative to the gas supply pipeline to provide good acoustic coupling between the signal source unit 362 and the gas supply pipeline.

As is shown in FIG. 20, a securing arrangement 363 keeps the mounting arrangement 360 securely fastened to the gas supply pipeline. The mounting arrangement 360 may incorporate acoustic coupling material 361 to enhance transmission of acoustic or seismic signals generated by the signal source unit 362 to the gas supply pipeline.

Figure 18:
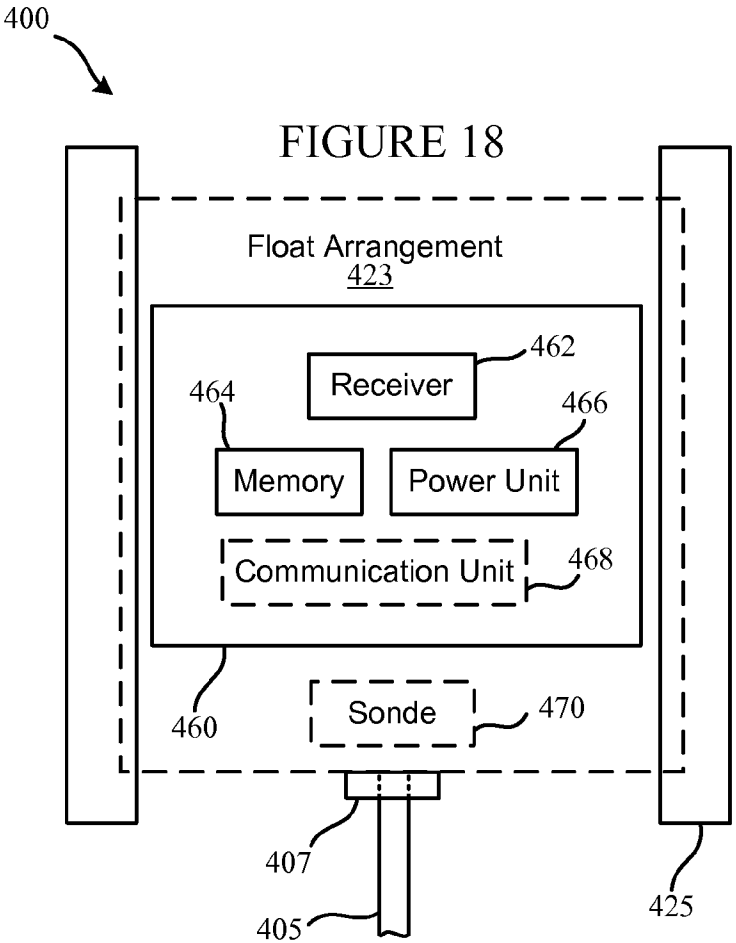
FIGS. 17 and 18 are block diagrams showing various components of a signal source apparatus and a receiver apparatus, respectively, in accordance with various embodiments.
Figure 17:
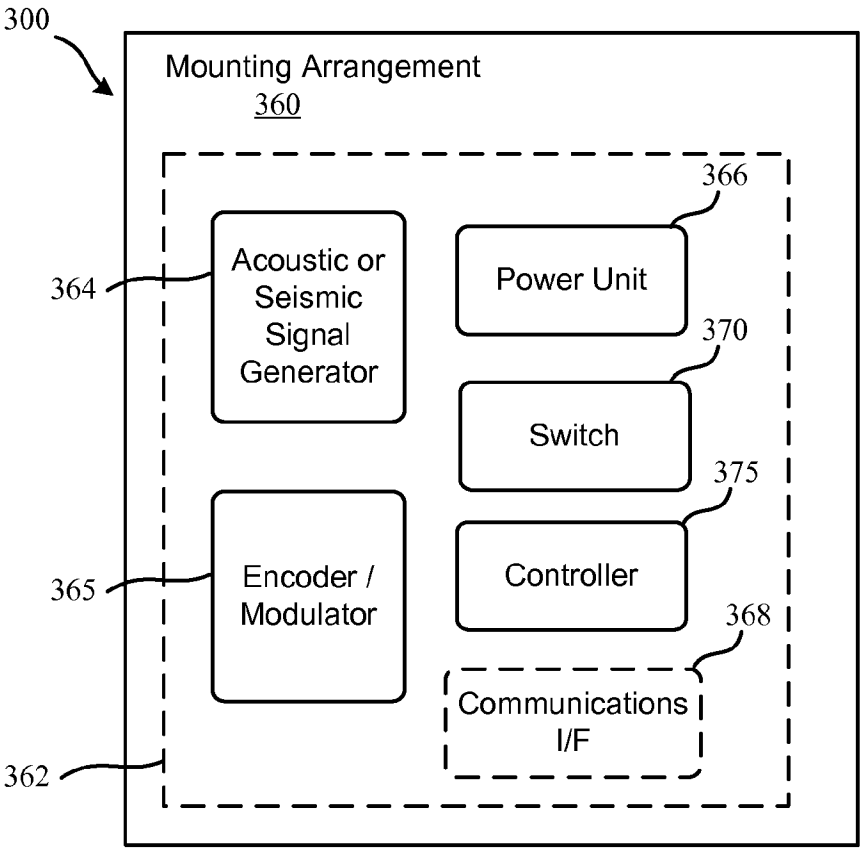

FIGS. 17 and 18 are block diagrams showing various components of a signal source apparatus 300 and a receiver apparatus 400, respectively. The signal source apparatus 300 shown in FIG. 17 includes a signal source unit 362 and a mounting arrangement 360. The signal source unit 362 includes an acoustic or seismic signal generator 364, which may include an acoustic vibrator, a shaker, or a seismic generator. The signal generator 364 may generate a signal having a single frequency or a signal having a multiplicity of frequencies. The signal generator 364 may be a continuous wave (CW) generator that generates a continuous wave train. The signal generator 364 may be a pulse signal generator, such as an impulse generator that generates a series of pulses.

An encoder or modulator 365 may be coupled to the signal generator 365, and configured to impress information onto the source signal produced by the signal generator 365. The encoder 365 may include a chirp modulator, for example. Data impressed onto the source signal may include data helpful in identifying the gas supply pipeline from which a source signal detected by the receiver apparatus 400 originates. For example, each signal source apparatus 300 may have a memory that stores a unique identifier in non-volatile memory that uniquely identifies the building to which the gas supply pipeline provides service. This unique identifier may be encoded onto the source signal produced by the signal generator 365.

In one embodiment, each gas supply pipeline within a predefined region is tagged with an RFID tag that includes a unique identifier. The RFID tag can be secured to the gas supply pipeline using an adhesive or other affixation arrangement. When the signal source unit 362 is activated, a communication circuit 368 reads the identifier from the RFID tag and impresses this identifier onto the source signal it generates. This approach provides for easy and relatively foolproof management of generic signal source units 362, and obviates the need to program each signal source unit 362 for each building.

The signal source unit 362 includes a power unit 366, which may draw power from a power source from the house or building, a long-life battery, or other form of energy. A switch 370 may be included to allow controlled activation and deactivation of the signal source unit 362. The switch 370 may be a manual switch or can be controlled via a command signal received from a communications unit 368 (e.g., a command signal generated by a field laptop or a utility office computer). The switch 370 may incorporate a wake-up circuit. The power consuming electronics of the signal source unit 362, for example, may be operated at full power only when needed. Nominal operating power is supplied to the source signal unit electronics in response to the wake-up circuit. The wake-up circuit may also control transition of the signal source unit electronics from an active mode to a sleep mode. A controller 375 is provided to manage operations of the signal source unit 362.

The receiver apparatus 400 includes a receiver unit 460 and a float arrangement 423. The float arrangement 423 may include a flotation device and/or a kite. A skid 425 may also be included to protect the receiver unit 460 from contacting sewer walls. The receiver unit 460 includes a receiver 462, which may be a microphone, an acoustic transducer, or a seismic transducer. The microphone may have a conventional design or may incorporate a MEMS (MicroElectrical-Mechanical System) microphone, for example. The seismic transducer may incorporate a geophone, for example.

A memory 464 is coupled to the receiver 462 and is configured to store monitoring data produced by the receiver 462. As discussed previously, the memory 464 may include one or both of fixed and removable memory. A communications unit 468 may be incorporated in some embodiments for transmitting real-time monitoring data to a surface device via a hardwire or wireless communication link. A sonde 470 may be situated proximate the receiver unit 460 for producing a beacon signal that can be detected using an above-ground detector. Monitoring data can be impressed onto the beacon signal, such as by modulating the beacon signal using a monitoring data signal. A coupler 407 is provided on the receiver apparatus 400 that facilitates attachment and detachment of the receiver unit 460 to and from the transport member or arrangement 405.

Figure 21:
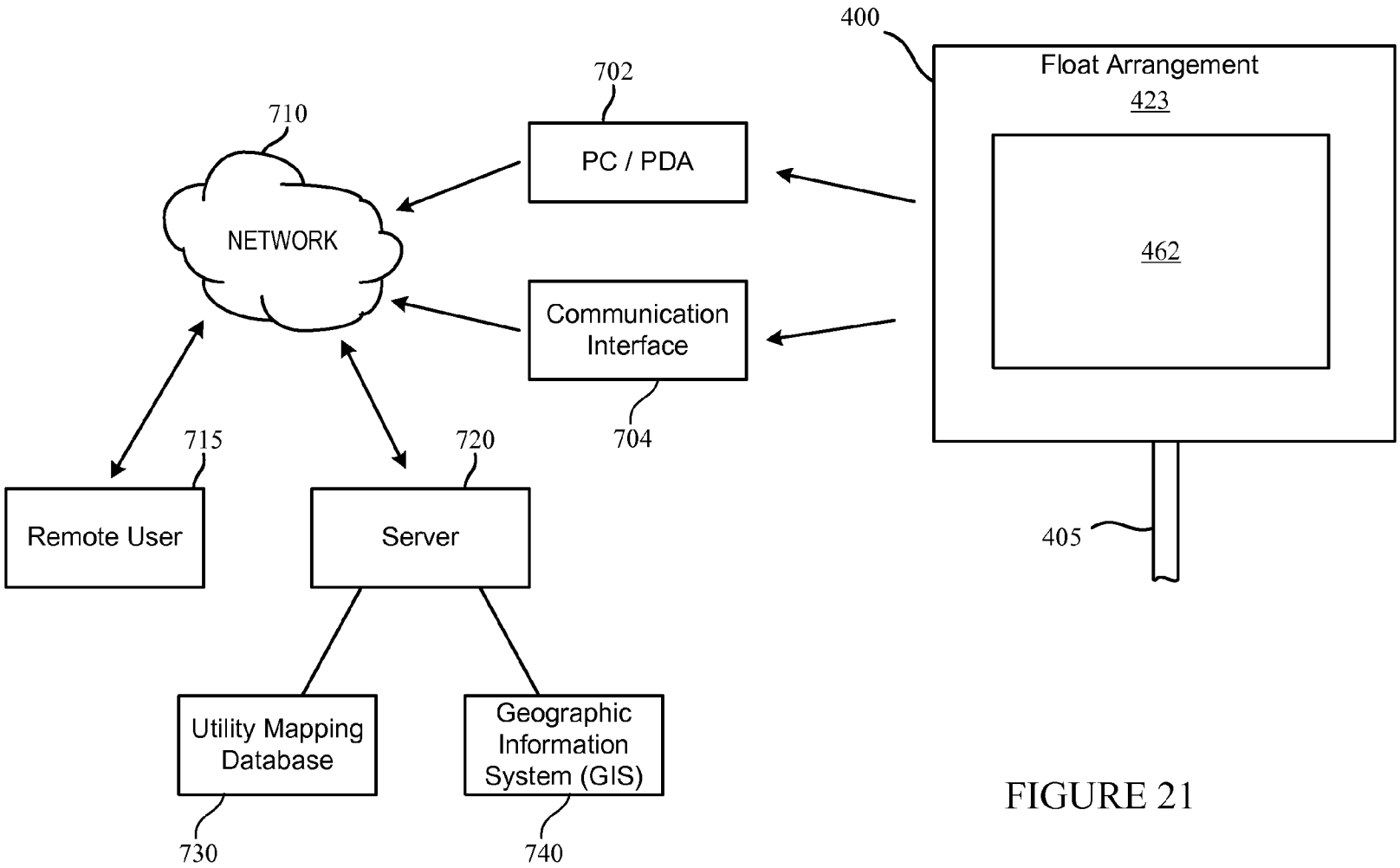
FIG. 21 is a block diagram of a system for managing cross bore data in accordance with various embodiments.

FIG. 21 is a block diagram of a system for managing cross bore data in accordance with embodiments of the invention. A receiver apparatus 400 of a type previously described is shown in FIG. 21. Monitoring data collected by the receiver unit 462 is transferred to an electronic device, which may be computer or PDA 702 (e.g., PC, laptop, netbook, smartphone) or other device having a communication interface 704. The monitoring data is communicated to a server 720 over a network 710. The network 710 may be the Internet, a cellular network, a landline network, a WAN, a LAN, or other type of network.

The server 720 may support or otherwise provide access to a utility mapping database 730 or a GIS 740. The server preferably performs authentication and authorization of users who wish to access the server 720. Access to the server 720 may be predicated on a fee structure, with different users or entities granted access to different data on the server 720 based on pre-established fee arrangements. Monitoring data is preferably stored in the utility mapping database 730 or a GIS 740, and updated when new cross bore monitoring and/or detection data is acquired.

Managing cross bore detection data via a networked server information system provides for rapid acquisition of cross bore detection and location data from a multiplicity of geographic locations and authorized entities/users. A networked server information system that manages cross bore data allows for large volumes of cross bore data to be incorporated into and managed by utility mapping databases 730 or a GISs 740 for professional, municipal, state, and federal agencies and entities.

The discussion and illustrations provided herein are presented in an exemplary format, wherein selected embodiments are described and illustrated to present the various aspects of the invention. Systems, devices, or methods according to the invention may include one or more of the features, structures, methods, or combinations thereof described herein. For example, a device or system may be implemented to include one or more of the advantageous features and/or processes described herein. A device or system according to the invention may be implemented to include multiple features and/or aspects illustrated and/or discussed in separate examples and/or illustrations. It is intended that such a device or system need not include all of the features described herein, but may be implemented to include selected features that provide for useful structures, systems, and/or functionality.

What is claimed is:

1. A method, comprising:

generating, using a signal generator, an acoustic or seismic source signal;

communicating, via the signal generator, the source signal to a gas supply pipeline;

moving a receiver through a sanitary or storm sewer situated in proximity to the gas supply pipeline;

monitoring for a cross bore involving the gas supply pipeline and the sewer in response to the receiver receiving the source signal emanating from the gas supply pipeline as the receiver progresses through the sewer; and detecting, using a processor, a cross bore involving the gas supply pipeline and the sewer using monitoring data acquired by the receiver.

2. The method according to claim 1, comprising recording, in a memory, monitoring data acquired at the receiver during monitoring.

3. The method according to claim 1, comprising transmitting, via a communications unit, monitoring data acquired at the receiver to an above-ground location.

4. The method according to claim 1, comprising:

storing, in a memory, monitoring data acquired at the receiver; and updating, using a processor, the stored monitoring data to reflect confirmation data indicating whether or not the detected cross bore is an actual cross bore.

5. The method according to claim 1, wherein the source signal comprises a single frequency or a plurality of disparate frequencies.

6. The method according to claim 1, comprising communicating monitoring data acquired at the receiver to a database via a network.

7. The method according to claim 1, comprising incorporating monitoring data acquired at the receiver in a utility mapping database.

8. The method according to claim 1, comprising incorporating monitoring data acquired at the receiver in a geographic information system (GIS).

9. The method according to claim 1, comprising:

incorporating monitoring data acquired at the receiver in a utility mapping database or a geographic information system (GIS); and providing access to the monitoring data incorporated in the utility mapping database or the GIS by a remote user.

10. The method according to claim 1, comprising:

storing monitoring data acquired at the receiver and associated with a predefined region in a utility mapping database or a geographic information system (GIS);

updating the stored monitoring data to reflect confirmation data indicating whether or not the detected cross bore is an actual cross bore; and generating output data including updated data for the predefined region from the utility mapping database or GIS.

11. The method according to claim 1, comprising:

measuring, using an encoder or sonde signal, travel distance of the receiver relative to a reference location; and estimating a location of the cross bore using the measured travel distance.

12. The method according to claim 1, comprising providing flotation for the receiver to facilitate movement of the receiver.

13. The method according to claim 1, comprising:

generating, using signal generators, an acoustic or seismic source signal for each of a plurality of gas supply pipelines;

communicating, via the signal generators, the source signals to the gas supply pipelines;

moving the receiver through a sanitary or storm sewer having one or more sewer laterals situated in proximity to the gas supply pipelines;

monitoring for the source signals using the receiver; and detecting, using the processor, a cross bore involving any of the gas supply pipelines and the one or more sewer laterals using monitoring data acquired by the receiver.

14. The method according to claim 13, comprising encoding or modulating the source signals to include data useful for identifying the respective gas supply pipelines.

15. A system, comprising:

a signal source apparatus, comprising:

a signal source unit configured to generate an acoustic or seismic source signal; and a mounting arrangement configured to secure the signal source unit to a gas supply pipeline and to facilitate communication of the source signal from the signal source unit to the gas supply pipeline; and a receiver apparatus, comprising:

a receiver unit comprising a receiver coupled to a memory, the receiver configured for sensing the source signal and to output source signal data, and the memory configured to store monitoring data comprising the source signal data;

a transport apparatus comprising a coupler configured to couple the receiver unit to the transport apparatus, the transport apparatus facilitating movement of the receiver unit through a sanitary or storm sewer situated in proximity to the gas supply pipeline; and a processor configured to detect a cross bore involving the gas supply pipeline and the sanitary or storm sewer using monitoring data stored in the memory of the receiver unit.

16. The system according to claim 15, wherein the receiver apparatus comprises a float arrangement configured to provide flotation for the receiver unit.

17. The system according to claim 15, wherein the receiver apparatus comprises:

a float arrangement configured to provide flotation for the receiver unit; and a skid apparatus configured to support the receiver unit and protect against direct contact between the receiver unit and a wall of the sewer.

18. The system according to claim 15, wherein the transport apparatus comprises a wire, a cable, a tether, a polymeric line, a fiberglass line, or a pushrod.

19. The system according to claim 15, wherein the transport apparatus comprises a pushrod comprising one or more conductive wires.

20. The system according to claim 15, wherein the receiver unit comprises a communication unit configured to transmit the monitoring data to an above-ground device.

21. The system according to claim 15, wherein the receiver unit comprises a sonde.

22. The system according to claim 15, wherein the signal source unit comprises an acoustic vibrator, a shaker, or a seismic generator.

23. The system according to claim 15, wherein the signal source unit comprises an acoustic or seismic generator configured to generate an source signal comprising a single frequency or a plurality of frequencies.

24. The system according to claim 15, wherein the processor is disposed on the receiver unit.

25. The system according to claim 15, wherein the processor comprises a portable computer or portable processing system.

26. The system according to claim 15, wherein the processor comprises communication circuitry configured to communicatively couple the processor with a network, server, or a remote system, the processor configured to communicate the monitoring data to the network, server, or remote system via the communication circuitry.

* * * * *